US008490835B2

(12) United States Patent
Benyamin et al.

(10) Patent No.: US 8,490,835 B2
(45) Date of Patent: Jul. 23, 2013

(54) CONTAINER COVER ASSEMBLY

(75) Inventors: Tal Benyamin, Beer-Sheva (IL); Eran Aharon Medina, Beer-Sheva (IL); Asaf Galili, Beer-Sheva (IL)

(73) Assignee: Apus Innovation Ltd, Beer-Sheva (IL)

( * ) Notice: Subject to any disclaimer, the term of this patent is extended or adjusted under 35 U.S.C. 154(b) by 1143 days.

(21) Appl. No.: 11/918,278

(22) PCT Filed: Apr. 6, 2006

(86) PCT No.: PCT/IL2006/000445

§ 371 (c)(1),
(2), (4) Date: Feb. 4, 2009

(87) PCT Pub. No.: WO2006/109297

PCT Pub. Date: Oct. 19, 2006

(65) Prior Publication Data

US 2009/0212002 A1 Aug. 27, 2009

(30) Foreign Application Priority Data

Apr. 11, 2005 (IL) ..... 167965

(51) Int. Cl.

| | |
|---|---|
| ***B65D 55/02*** | (2006.01) |
| ***B65D 39/00*** | (2006.01) |
| ***B65D 41/00*** | (2006.01) |
| ***B65D 43/00*** | (2006.01) |
| ***B65D 41/04*** | (2006.01) |
| ***B65D 41/34*** | (2006.01) |
| ***B65D 43/12*** | (2006.01) |
| ***B65D 43/20*** | (2006.01) |
| ***B65G 59/00*** | (2006.01) |
| ***B65H 3/00*** | (2006.01) |
| ***G07F 11/16*** | (2006.01) |
| ***G07F 11/00*** | (2006.01) |
| ***A47F 1/04*** | (2006.01) |
| ***A47G 19/00*** | (2006.01) |
| ***A47G 19/12*** | (2006.01) |
| ***B67B 1/00*** | (2006.01) |

(52) U.S. Cl.

USPC ..... 222/142.1; 215/221; 215/297; 215/301; 215/330; 220/345.1; 220/348; 220/915; 221/151; 221/152; 221/154; 221/288; 222/142.2; 222/153.13; 222/457.5

(58) Field of Classification Search

USPC ..... 215/297, 221, 301, 330; 220/345.1, 220/348, 915; 221/151, 152, 154, 288; 222/142.1, 142.2, 153.13, 457.5

See application file for complete search history.

(56) References Cited

U.S. PATENT DOCUMENTS

| | | | | |
|---|---|---|---|---|
| 3,120,318 | A * | 2/1964 | Rigor | 215/206 |
| 3,311,247 | A | 3/1967 | Rigor | |
| 3,869,057 | A | 3/1975 | Miller | |
| 5,052,584 | A * | 10/1991 | Dubach | 221/152 |

OTHER PUBLICATIONS

International Search Report dated Aug. 2, 2006, issued in PCT/IL2006/000445.

* cited by examiner

*Primary Examiner* — Anthony Stashick
*Assistant Examiner* — Andrew T Kirsch
(74) *Attorney, Agent, or Firm* — Venable LLP; Robert Kinberg

(57) ABSTRACT

A container cover assembly that has at least two states. In the first, closed state, the removal of the contents of the container through the opening of the container is prevented. In the second, open state, the removal of the contents of the container through the opening of the container is possible. The cover assembly comprises a mechanism for preventing the transfer of the cover assembly from the first state to the second state, unless at least a predetermined number of shaking motions is applied to the container and cover assembly.

42 Claims, 36 Drawing Sheets

D-D

CONTAINER COVER ASSEMBLY

BACKGROUND

The present invention relates in general to container covers. In particular, the present invention relates to a container cover that hinders inadvertent or unintentional removal of the contents of a container therefrom. More particularly, the present invention relates to a container cover that requires a shaking motion in order to allow the removal of the contents of a container therefrom.

TECHNICAL FIELD OF THE INVENTION

Medicines, drugs and other potentially dangerous substances such as insecticides, weed-killing chemicals, fungicides, harsh detergents and the like are occasionally stored in containers kept in a home. This creates a potential problem because children must not gain access to such substances. Moreover, some containers having potentially dangerous contents may be of similar appearance to other containers with generally safe contents. Hence, an adult who does not pay careful attention to which container he chooses, may inadvertently open the wrong container.

A well known safety feature that has been implemented for covers of such containers is that in which at least one motion, in addition to rotating the cover about its axis, is required in order to remove the cover from the container. Requiring an additional motion makes it more complicated to remove the cover by requiring more manual dexterity and coordination than a child generally possesses. Furthermore, by requiring an adult who desires to open such a container to spend an extra amount of time on this procedure, he may pay more careful attention to the container that he is attempting to open in order to verify that it is indeed the desired container.

The additional required motion may include providing a significant amount of a downward axial force to the cover, thereby releasing a locking mechanism, or, alternatively, laterally squeezing the cover inward prior to being able to rotate the cover about its axis.

However, the additional maneuver that is required to open such containers is often cumbersome even for adults, especially the elderly. Moreover, since pressing and squeezing maneuvers are well known, it is advantageous to require a different type of maneuver, which people are generally not familiar with, in order to remove covers from such containers.

U.S. Pat. No. 3,869,057 discloses one such safety cover, wherein a first closure is permanently attached to the open end of a container and a second closure is hingedly coupled with, and thus shiftable with respect to the first closure. The second closure is adapted in one position to cover, and in another position to uncover, the first closure. The second closure is sufficiently flexible laterally so as to become distorted in shape when opposed pressures are manually applied to the closure periphery, thereby allowing the safety cover to be rotated about its axis and removed from the container.

In addition, regarding containers that require the user to shake well before using, for instance containers having liquid medicaments, such as antibiotics, which require mixing by shaking the container prior to use, aerosol cans such as air fresheners, deodorants and spray paints, certain food and beverage products, cosmetics, etc., it is imperative that the user remembers to shake the container before opening in order for the contents to be effective.

It is therefore an object of the present invention to provide a container cover that hinders inadvertent removal of the contents of a container therefrom.

It is an additional object of the present invention to provide a container cover that, in order to be removed from the container, requires at least one significant maneuver to be performed, in addition to rotating the cover about its axis.

It is an additional object of the present invention to provide a container cover that requires the container and cover to be shaken prior to removal of the cover from the container, for instance, in order to ensure mixing of the contents of the container.

It is an additional object of the present invention to provide a container cover that hinders the removal of the contents of a container without first applying a shaking motion the container and the assembled cover.

It is an additional object of the present invention to provide a container cover that is inexpensive to produce.

It is an additional object of the present invention to provide a container cover that is at least partially comprised of components that are used in manufacturing conventional container covers.

Additional objects and advantages of the present invention will become apparent as the description proceeds.

SUMMARY OF THE INVENTION

The present invention relates to a container cover assembly having at least two states, a first, closed state, in which the removal of the contents of the container through the opening of said container is prevented, and a second, open state, in which the removal of the contents of said container through said opening of said container is possible, wherein said cover assembly comprises a mechanism for preventing the transfer of said cover assembly from said first state to said second state, unless at least a predetermined number of shaking motions is applied to said container and cover assembly.

The cover assembly further comprises an inner shell for positioning around the opening of the container and an outer cap for covering said inner shell, and wherein the mechanism comprises a coupler situated within said inner shell for allowing said cap to engage with said inner shell.

In the second state, said cover assembly may be removed from the opening of the container.

The coupler comprises:

a. an upper face;

b. a lower face;

c. an inner surface; and, d. an outer surface having an upper end and a lower end, and comprising at least one series of grooves extending from said upper end toward said lower end, wherein each groove in said series has a first side wall, a second side wall and an upper edge, and said coupler further comprising at least one recessed segment having a first side wall and a second side wall.

Each series of grooves comprises at least two grooves, thereby defining at least a first groove and a final groove, wherein said final groove extends longer than said first groove.

The upper end of the first side wall of each groove is chamfered.

The lower end of the outer surface of the coupler comprises an array of sawteeth.

The lower face of the coupler comprises at least one flexible stopper projecting downward therefrom, wherein each stopper comprises a fixed end that is affixed to said lower face, and a free end. Each stopper is inclined with respect to the lower face.

The lower face of the coupler comprises an array of spring members depending therefrom, wherein said spring members may be selected from a group consisting of:

a. compression springs;
b. torsion springs;
c. bending members.

The spring members provide support to the coupler such that upon compression, said coupler is lowered, and upon expansion, said coupler is raised.

The inner shell, having essentially cylindrical symmetry, comprises a longitudinal shell wall and a transversal partition, thereby defining a lower portion and an upper portion, wherein the inner surface of the shell wall of said lower portion is threaded to engage the opening of a container.

The inner surface of the shell wall of the upper portion comprises at least one positioning element projecting inward therefrom, dimensioned for lodging in a suitable groove, and at least one restricting element projecting inward therefrom, dimensioned for lodging in the recessed segment, wherein each of said positioning and restricting elements comprise a first side wall, a second side wall and a lower wall.

The coupler further comprises an array of spring grooves.

The inner shell comprises a shell portion and a ring portion, wherein when assembled, said ring portion is situated around the upper portion of said shell portion, wherein, a. said ring portion comprises at least one positioning element projecting inward therefrom, dimensioned for lodging in a suitable groove, and at least one restricting element projecting inward therefrom, dimensioned for lodging in the recessed segment, wherein each of said positioning and restricting elements comprise a first side wall, a second side wall and a lower wall;
b. said upper portion comprises suitable openings for said positioning and restricting elements to be disposed therein; and,
c. said upper portion further comprises a spring stopper comprising a head portion for selectively being lodged in and being dislodged from the spring groove.

The first side wall of the positioning element is chamfered at the lower end thereof.

When the positioning element is lodged in the first groove the coupler is defined as being in the initial, locked position, and when the positioning element is lodged in the final groove, the coupler is defined as being in the final, unlocked position.

The partition comprises an upper face having at least one flexible stopper projecting upward therefrom, wherein each stopper comprises a fixed end that is affixed to said upper face, and a free end having an upper tip.

Each stopper may be inclined with respect to the upper face of the partition.

The stopper is disposed below the sawteeth of the coupler such that the incline of the stopper is essentially parallel to that of the angled wall of each sawtooth.

Each stopper may be orthogonal to the upper face of the partition.

The partition preferably comprises an upper face having an array of sawteeth extending therefrom.

Preferably, the shell wall further comprises an outer surface having an annular rib extending around the periphery thereof.

Preferably, the outer cap, having essentially cylindrical symmetry, comprises a longitudinal wall and an inwardly facing upper surface having a bolt member depending therefrom, wherein said bolt member is threaded to engage the inner surface of the coupler.

The longitudinal wall comprises a lower end having at least one blocking member protruding radially inward therefrom.

Alternatively, according to a second embodiment, the coupler comprises a. an upper face;
b. a lower face;
c. an inner surface; and,
d. an outer surface having an upper end and a lower end, and comprising a series of grooves situated along the circumference of said outer surface and extending from said upper end toward said lower end, wherein each groove has a first side wall, a second side wall and an upper edge, and wherein said coupler further comprises a series of spring grooves at said lower end.

According to the second embodiment, the upper end of the first side wall of each groove is chamfered. The lower face of the coupler comprises at least one flexible stopper projecting downward therefrom, wherein each stopper comprises a fixed end that is affixed to said lower face, and a free end. Each stopper is inclined with respect to the lower face.

The lower face of the coupler of the second embodiment comprises an array of spring members depending therefrom, wherein said spring members may be selected from a group consisting of:

a. compression springs;
b. torsion springs;
c. bending members.

The spring members of the second embodiment provide support to the coupler such that upon compression, said coupler is lowered, and upon expansion, said coupler is raised.

The inner shell of the second embodiment comprises a longitudinal shell wall and a transverse partition, and further comprises a shell portion and a ring portion, wherein when assembled, said ring portion is situated around said shell portion, wherein, a. said ring portion comprises at least one positioning element projecting inward therefrom, dimensioned for lodging in a suitable groove, wherein each of said positioning elements comprises a first side wall, a second side wall and a lower wall;
b. said shell portion comprises suitable openings for said positioning elements to be disposed therein; and,
c. said shell portion further comprises a spring stopper comprising a head portion for selectively being lodged in and being dislodged from the spring groove.

In the second embodiment, the first side wall of the positioning element is chamfered at the lower end thereof. When the positioning element is lodged in the first groove the coupler is defined as being in the initial, locked position, and when the positioning element is lodged in the final groove, the coupler is defined as being in the final, unlocked position. The partition comprises an upper face having an array of sawteeth extending therefrom. The shell wall further comprises an outer surface having an annular rib extending around the periphery thereof.

According to a third embodiment, the inner shell is situated at the neck portion of an aerosol can. The outer cap, having essentially cylindrical symmetry, comprises a longitudinal wall and an inwardly facing upper surface integrally joined with the nozzle member of the aerosol can, depending therefrom.

According to all embodiments, the shaking motion is applied in an axial direction.

The present invention further relates to a method for enabling the removal of the contents of a container only after applying at least a predetermined number of shaking motions to the container and cover assembly, said method comprising:

a. providing a cover assembly for said container, said cover assembly having at least a closed state and an open state; wherein said cover assembly comprises a mechanism for preventing the transfer of said cover from said closed state to said open state, unless at least a predetermined number of shaking motions to said container and cover assembly, is applied;

b. applying said predetermined number of shaking motions to said container and cover assembly; thereby transferring said cover from said closed state to said open state; and, c. providing a downward force to said cover assembly;

The method further comprises rotating said cover assembly in a predetermined direction.

DETAILED DESCRIPTION OF THE PREFERRED EMBODIMENTS

The present invention is directed to a container cover that hinders inadvertent or unintentional removal of the contents of a container, and may additionally prevent the removal therefrom by children. According to the present invention, in order to remove the contents from a container, the user must first shake the cover a predetermined number of times. Moreover, the shaking of the container assures the mixing of its contents before use, as required in some cases.

For the sake of clarity, the phrase, "shaking motion" as used herein is to be defined generally as a motion, in particular, as applied to a container, that includes providing an axial force in an upward and/or downward direction, resulting in the spring members as described herein below compressing and expanding. The shaking motion may be applied by a human hand or by any other means including mechanical or electromechanical.

The term, "container" as used herein refers to any vessel in which contents may be stored therein.

The term, "forward rotation" refers herein to rotation motion typically in a clockwise direction.

The term, "retrograde rotation" refers herein to rotational motion in a direction opposite that of the forward rotation, typically in a counterclockwise direction.

The terms, "downward" and "upward" refer herein to directions relative to the longitudinal axis of the container, wherein "downward" is the direction toward the bottom of the container, and "upward" is the direction away from the bottom of the container.

Figure 1:
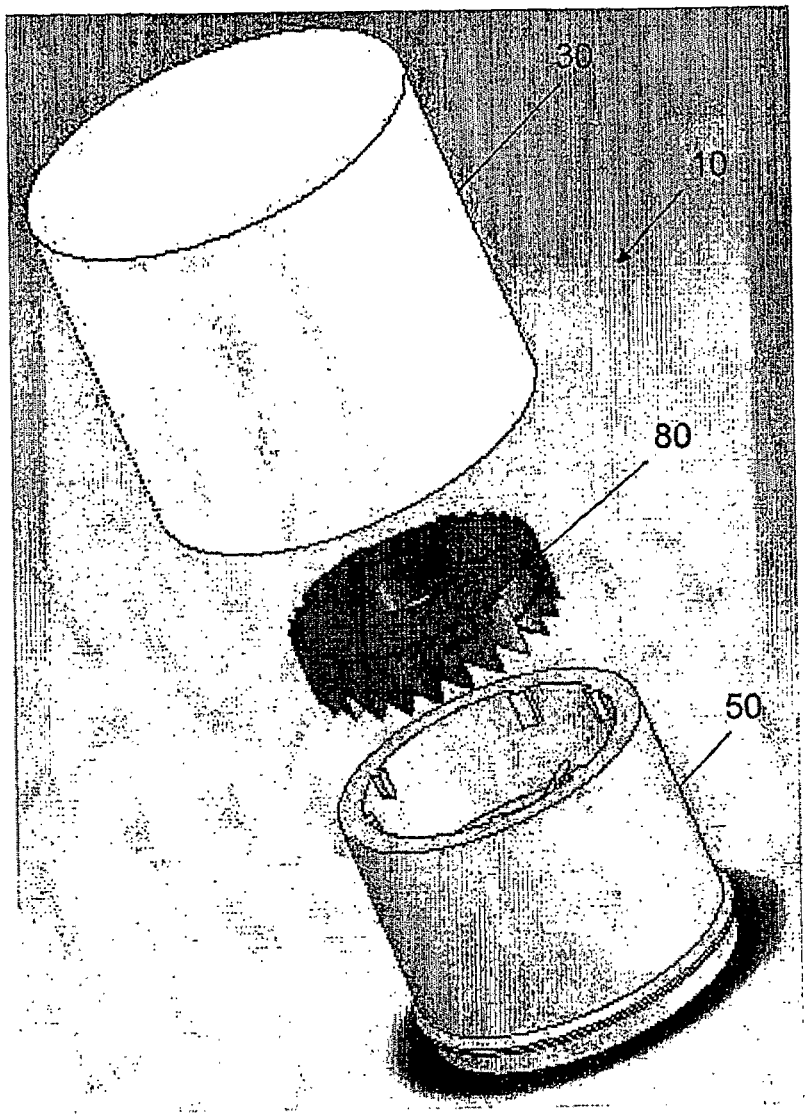
FIG. 1 illustrates an exploded view of the components of the container cover assembly of the present invention.

A first embodiment of the present invention is shown in FIG. 1 in an exploded view, wherein the container cover assembly is generally designated with the numeral (10), and comprises an inner shell (50) for sealing the open end of a container (not shown), a coupler (80) situated within the inner shell (50) and an outer cap (30) for covering the inner shell (50) and coupler (80).

Figure 2:
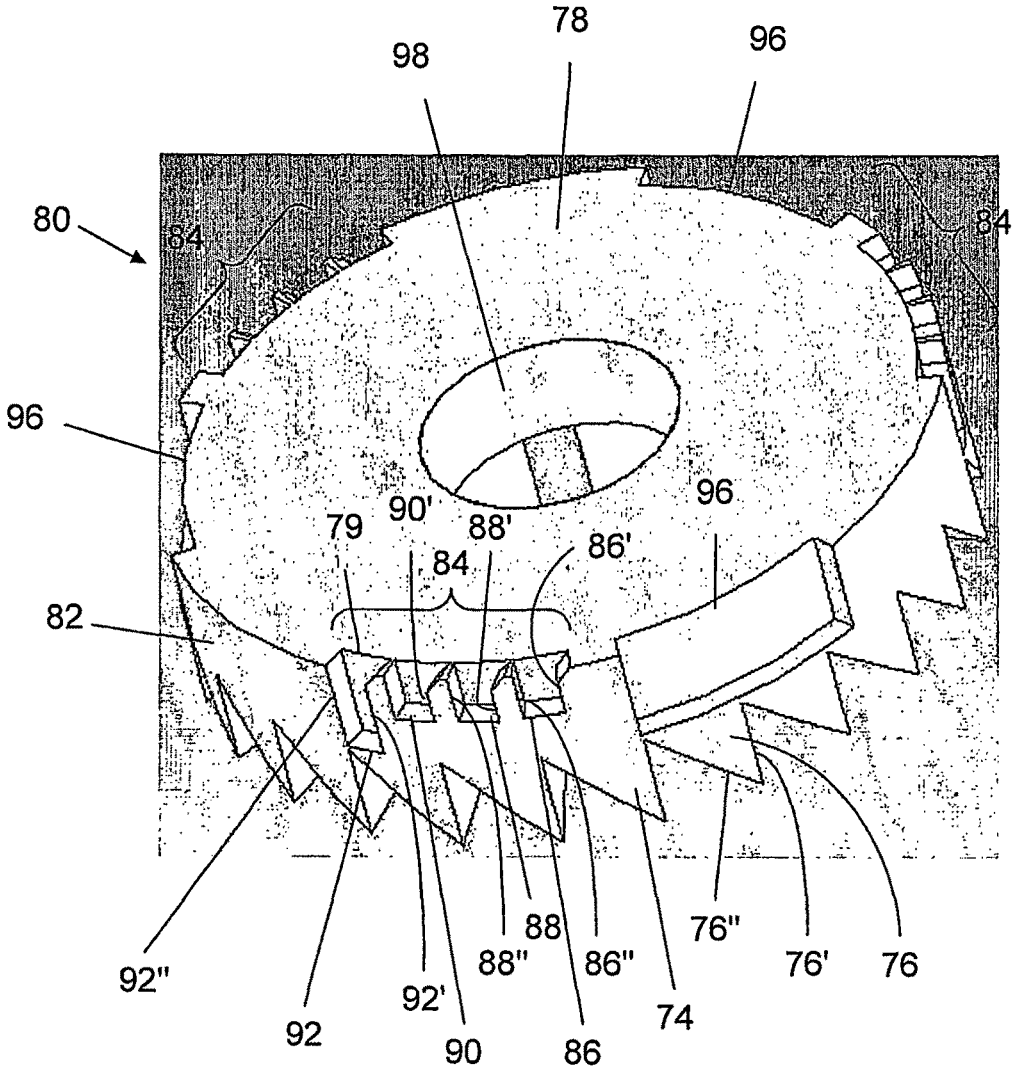
FIG. 2 illustrates a perspective view of the first embodiment of the coupler of the present invention.

Referring in particular to FIG. 2, a preferred embodiment of the coupler (80) is shown essentially annular in shape, having circular symmetry. The outer surface (82) of coupler (80) comprises three series of grooves (84) wherein each series (84) is identical to and spaced radially equidistant from each other series (84) along the perimeter of the surface (82). Each series (84) comprises four grooves (86), (88), (90), (92), wherein the first three grooves (86), (88), (90), extend to essentially the same distance as each other from the edge (79) of the upper face (78) toward lower end (74) of the coupler (80), and the fourth groove (92) extends from the edge (79) of the upper face (78) toward the lower end (74), a distance greater than that of any one of the first three grooves (86), (88), (90). The upper end of the first side wall (86'), (88'), (90'), (92') of each groove (86), (88), (90), (92) is chamfered.

Alternatively, the coupler (80) may comprise fewer than or more than three series of grooves (84), and/or situated at non-equidistant radial distances from one another, *mutatis mutandis*. Additionally or alternatively, each series (84) may comprise fewer or more than four grooves, though at least two. Additionally or alternatively, the grooves may extend to differing distances from one another, though the final groove is generally the longest groove in the series (84), *mutatis mutandis*.

The outer surface (82) further comprises three elongated radially recessed segments (96) along the periphery of the outer surface (82), each of which is identical to and spaced radially equidistant from the other.

Alternatively, the outer surface (82) may comprise fewer or more than three radially recessed segments (96), and/or situated at non-equidistant radial distances from one another, *mutatis mutandis*.

Although not shown in the figures that illustrate the first embodiment, inner surface (98) of the coupler (80) is suitably threaded to receive the depending bolt member (34) of the outer cap (30), shown in FIG. 5*b*, as will be described further herein below. It is important to note that the inner surface (98) is threaded such that retrograde rotation allows the bolt member (34) to be received therein.

An array of twenty-four sawteeth (76) in an annular arrangement form the lower end (74) of the outer surface (82) of the coupler (80). Each sawtooth (76) has one side wall (76') essentially orthogonal to the upper face (78) of the coupler (80) and one inclined wall (76"), angled with respect to the upper face (78) of the coupler (80).

Alternatively, the coupler (80) may comprise fewer or more than twenty-four sawtweeth (76), *mutatis mutandis*.

Figure 3A:
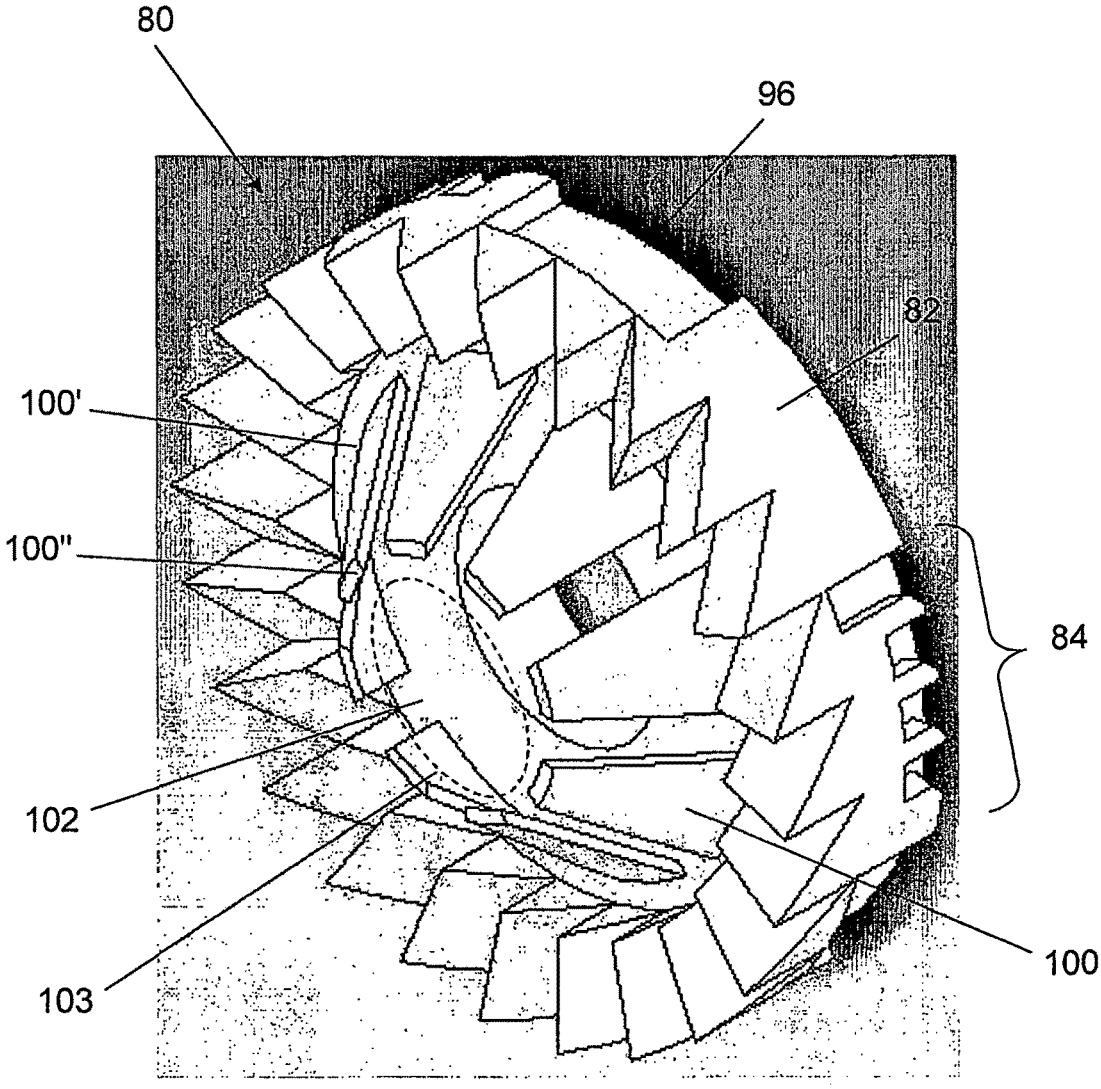
FIGS. 3*a* and 3*b* illustrate a perspective view of the underside of the coupler of FIG. 2, showing the spring members in extended (FIG. 3*a*) and compressed (FIG. 3*b*) positions.
Figure 3B:
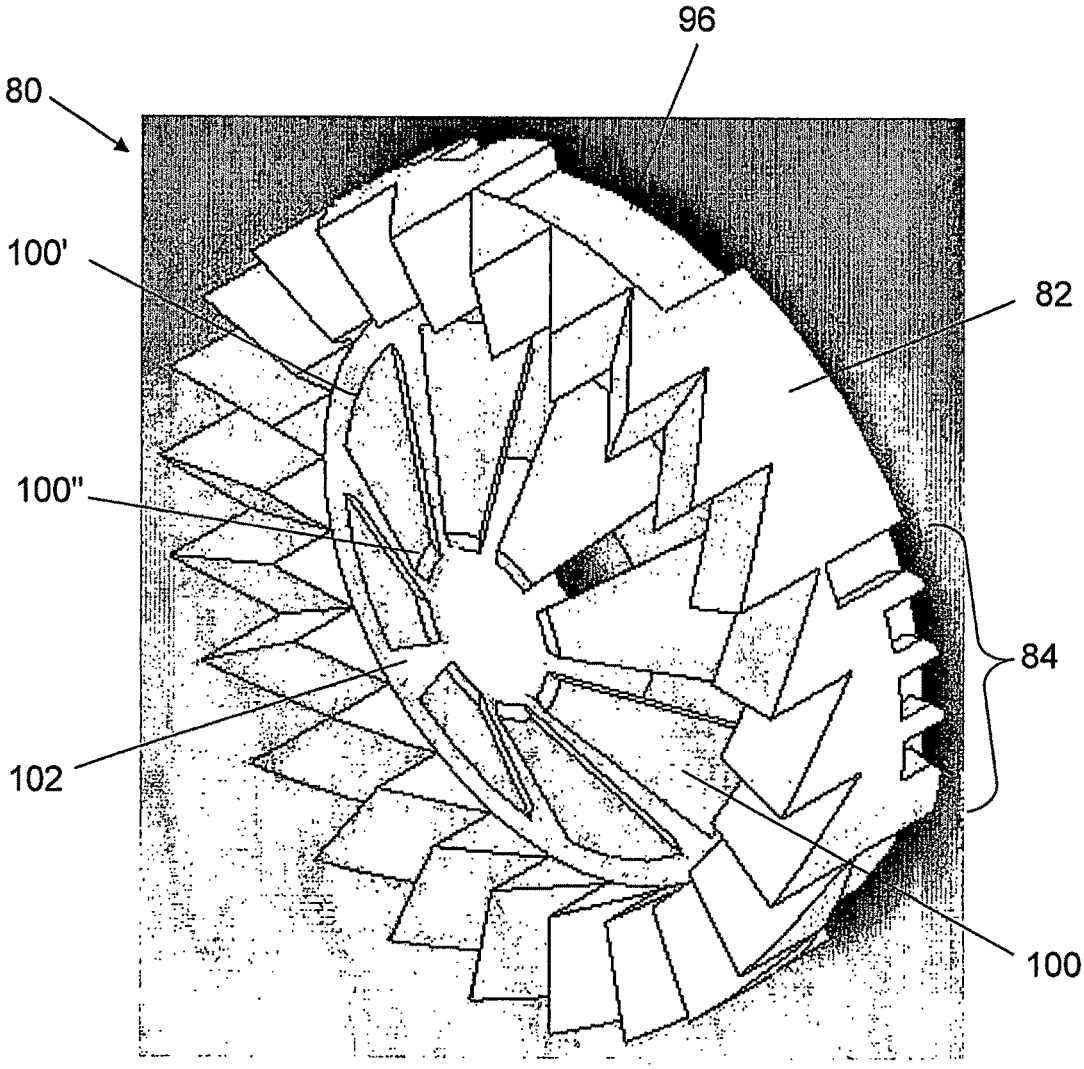

FIGS. 3*a* and 3*b* show the underside of the coupler (80) having an array of eight spring members (100) in an annular arrangement, in expanded (FIG. 3*a*) and compressed (FIG. 3*b*) positions. Each spring member (100) depends at an incline from the lower face (102) of the coupler (80), having a fixed end (100') affixed to the lower face (102) by suitable means such as epoxy, or alternatively, joined as an integral part thereof, and a free end (100"). According to the preferred embodiment, as seen in FIG. 3*a*, the inner diameter of the ring that is formed by the tips of the free ends (100") of the spring members (100) in the expanded position, as indicated by dotted lines (103), is less than the inner diameter of the projecting ring (58) of the inner shell (50) (see FIG. 4*a*).

Alternative, the coupler may have fewer or more than eight spring members (100), *mutatis mutandis*.

Alternatively, the spring members (100) comprise any suitable spring or spring-like member including but not limited to any form of a spiral compression or torsion spring, *mutatis mutandis*.

Figure 4A:
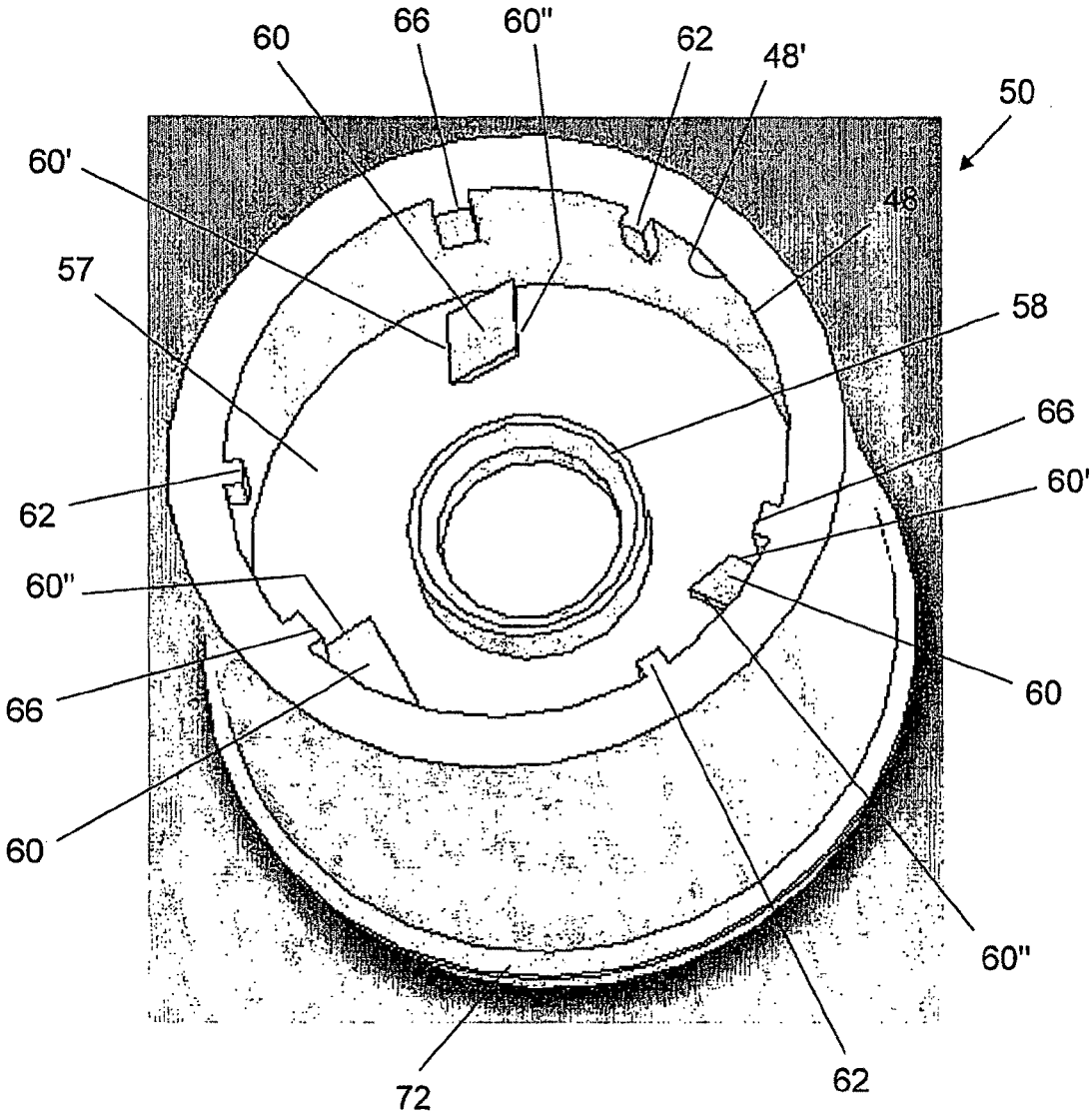
FIGS. 4*a*, 4*b* and 4*c* illustrate a perspective view (FIG. 4*a*) and a top view (FIG. 4*b*) of the first embodiment of the inner shell of the present invention, as well as a cross-sectional side projection view taken along A-A of FIG. 4*b* (FIG. 4*c*), showing the positioning element, the restricting element and the inclined stoppers.
Figure 4B:
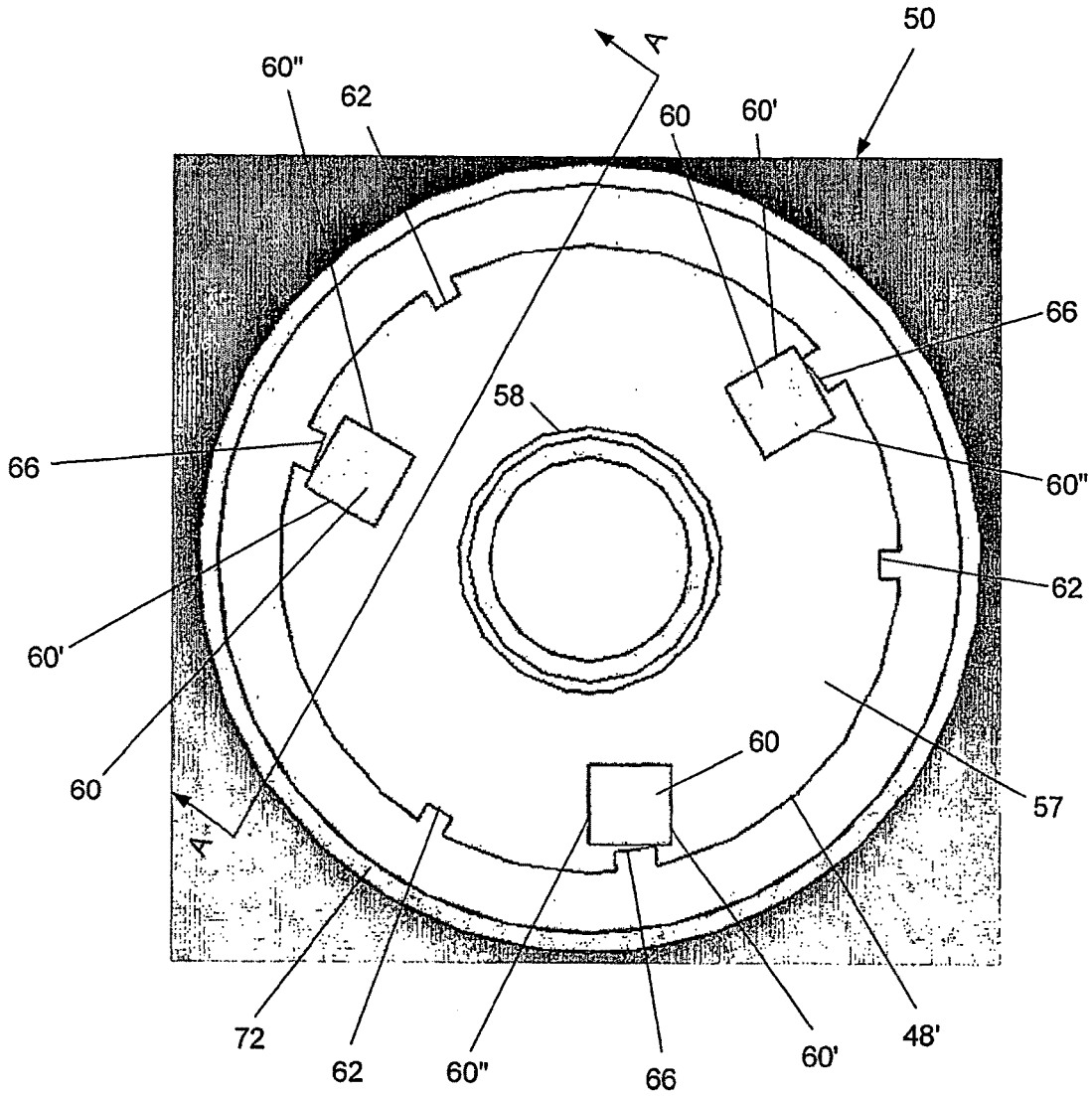
Figure 4C:
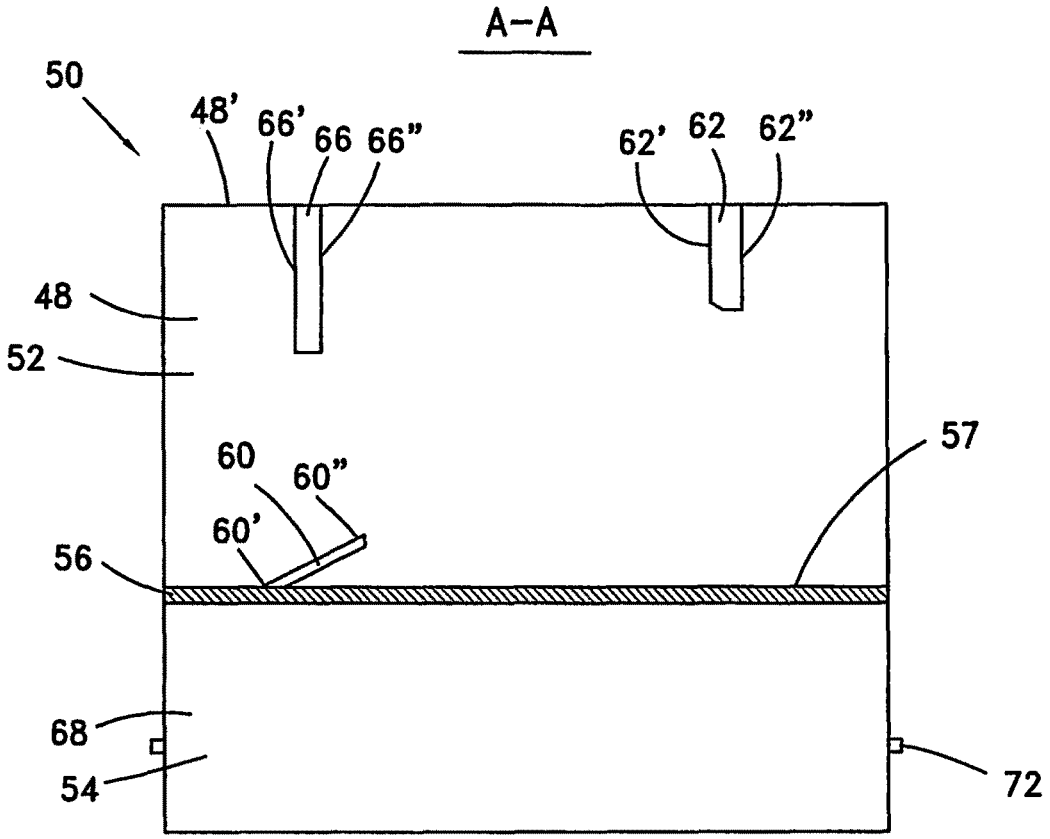

Referring in particular to FIGS. 4*a*, 4*b* and 4*c*, wherein FIG. 4*a* shows inner shell (50) in perspective view, FIG. 4*b* shows inner shell (50) in top view and FIG. 4*c* shows a schematic cross-sectional side projection view of inner shell (50) taken along A-A of FIG. 4*b*, the inner shell (50) comprises an upper portion (52) and a lower portion (54) (also seen in FIG. 10) separated by a partition (56) having a centrally situated ring (58) and three inclined stoppers (60) projecting upward from upper face (57) of the partition (56). Each inclined stopper (60) is identical to and spaced radially equidistant from each other about the central axis of the shell (50). Each inclined stopper (60) is angled with respect to the partition (56), and has a fixed end (60') affixed to partition (56) by suitable means such as epoxy, or alternatively, joined as an integral part thereof, and a free end (60").

Three positioning elements (62) and three restricting elements (66) project radially inward from the upper end (48') of the inner surface (48) of the side wall of the upper portion (52). Each restricting element (66) is identical to and spaced radially equidistant from the other about the central axis of the shell (50). Similarly, each positioning element (62), comprising a first side wall (66') chamfered at its lower end, is identical to and spaced radially equidistant from the other about the central axis of the shell (50).

Alternatively, the inner shell (50) may comprise fewer of more than three of each element (62), (66), and inclined members (60).

Although not shown in the figures, the inner surface (68) of the wall of the lower portion (54) is preferably threaded to suitably engage the open end of a container, as described herein below.

Figure 10:
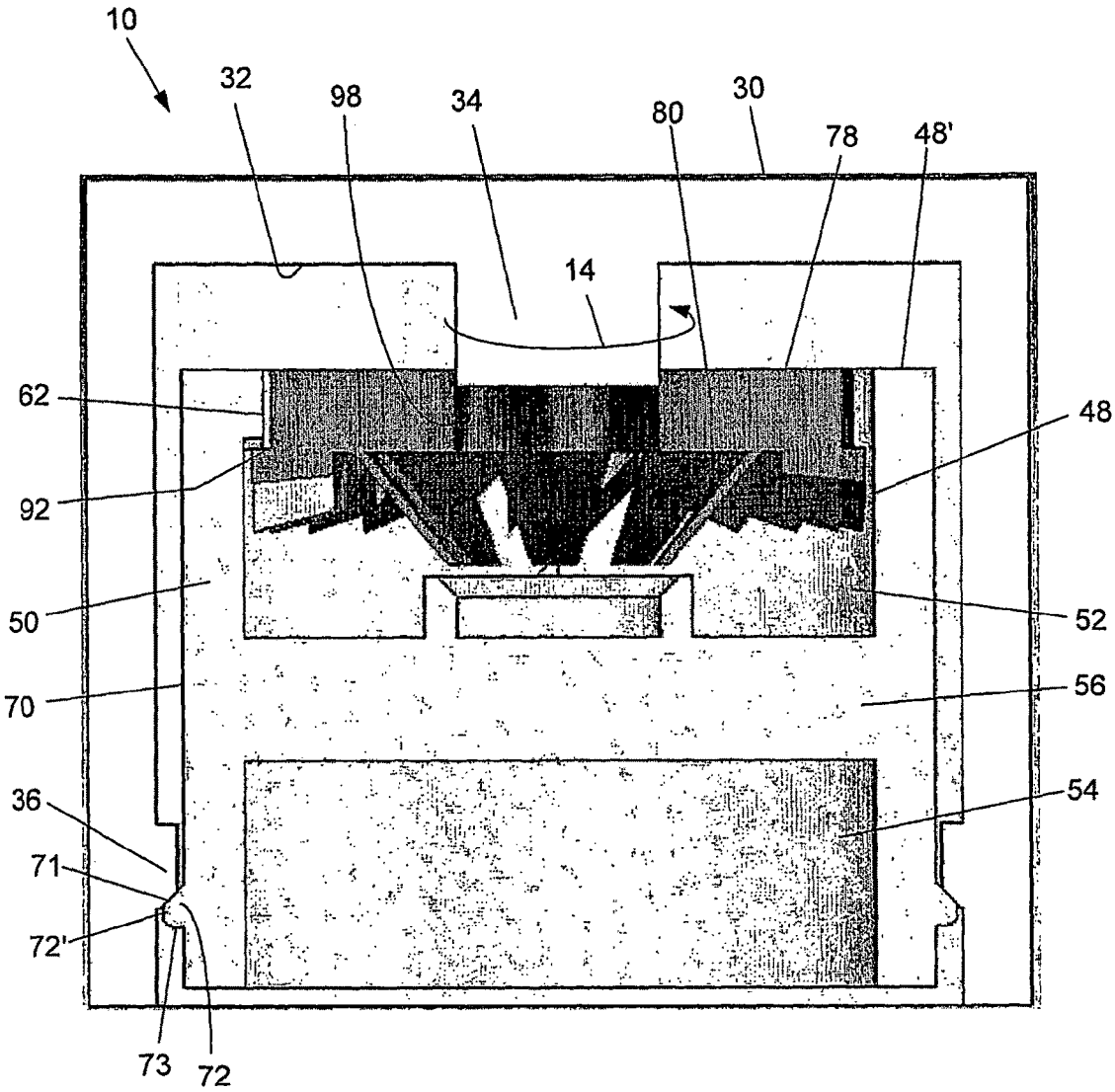
FIG. 10 illustrates a cross-section of the view shown in 6*b*, taken along C-C, including the outer cap covering the inner shell.

As best seen in FIGS. 4*a* and 10, and described in further detail herein below, an annular rib (72) surrounds the lower end of the outer surface (70) of the wall of the inner shell (50).

Figure 5A:
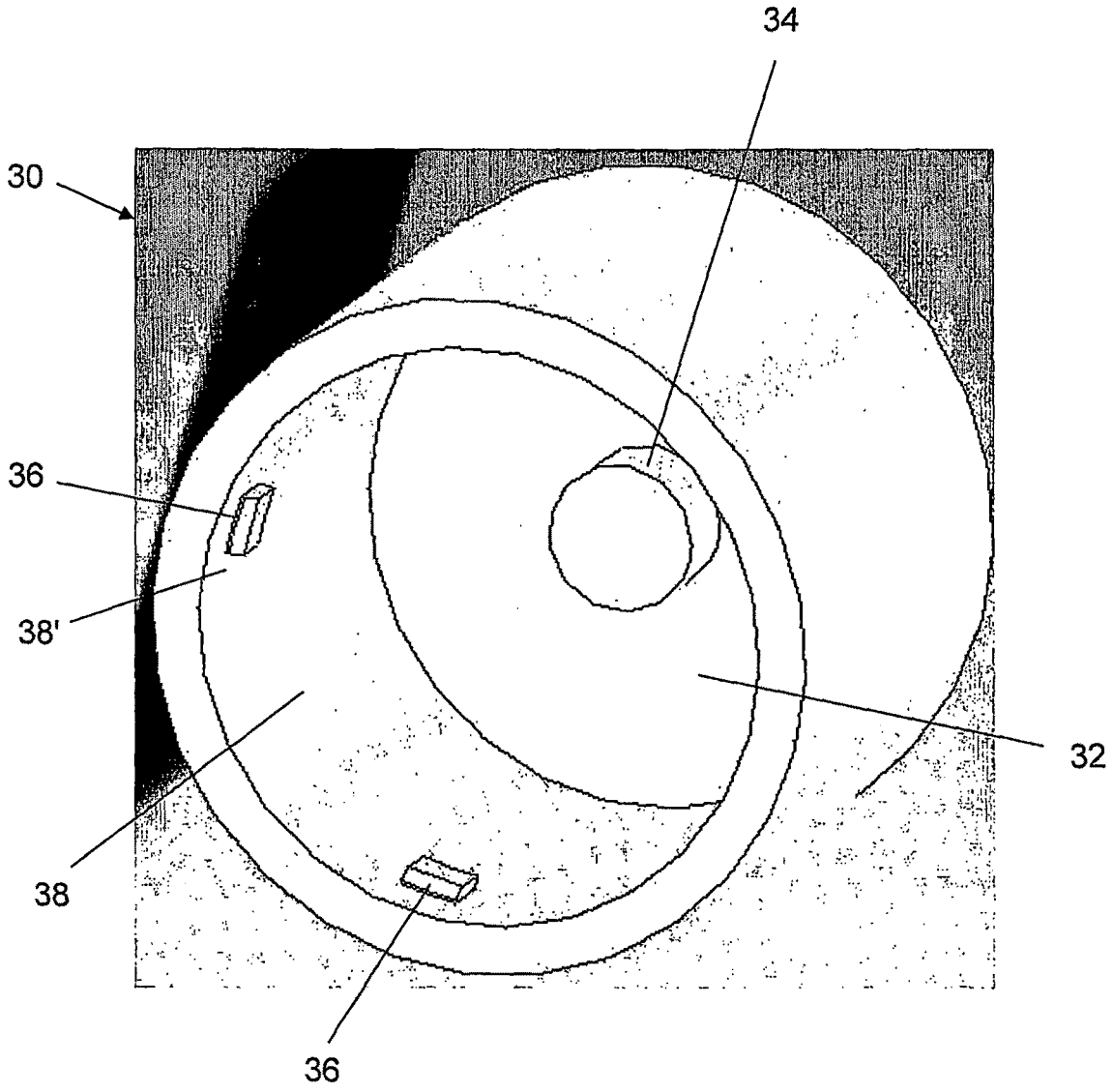
FIGS. 5*a* and 5*b* illustrate a perspective view (FIG. 5*a*) and a bottom view (FIG. 5*b*) of the first embodiment of the outer cap of the present invention.
Figure 5B:
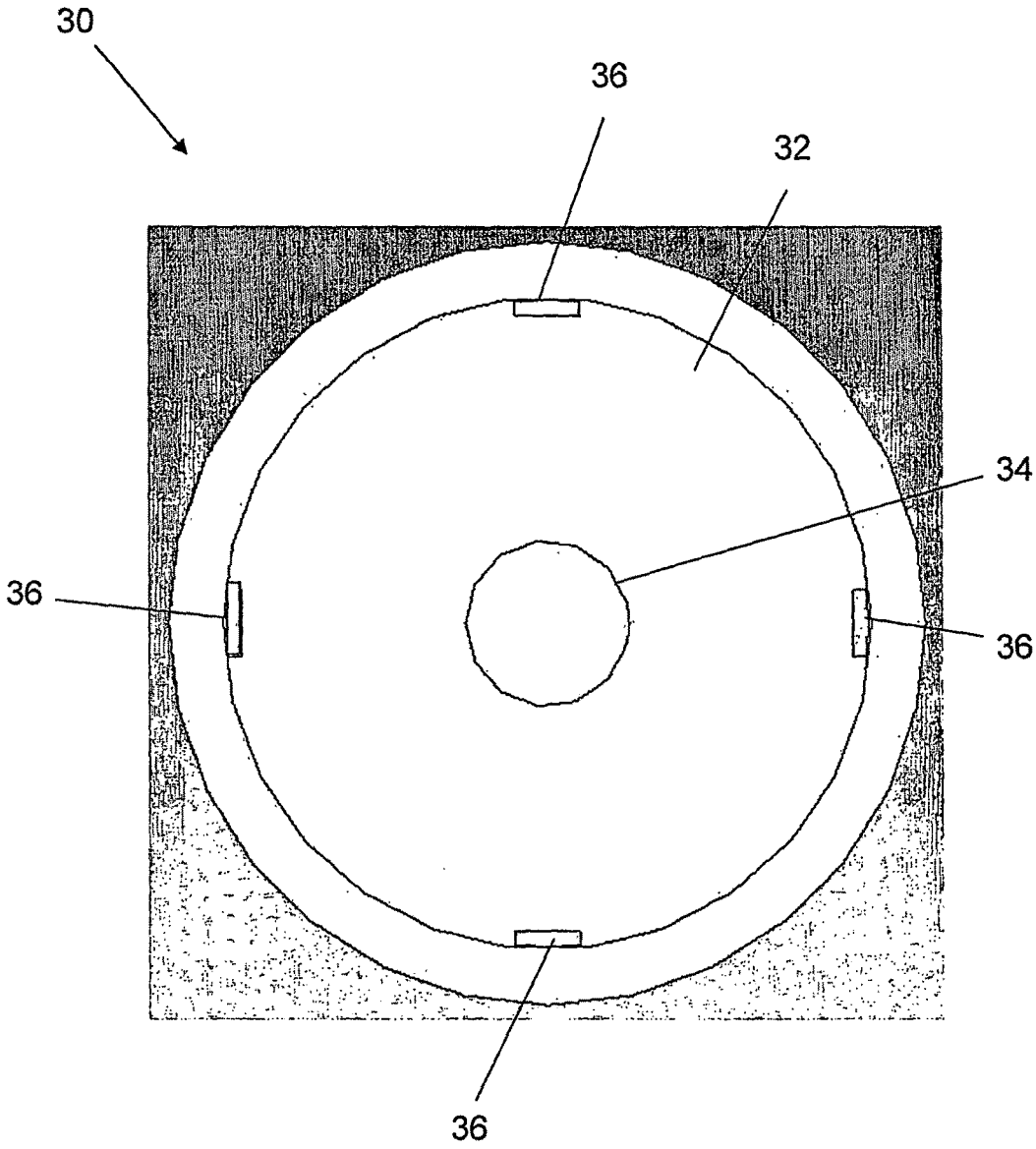

Referring to FIGS. 5*a* and 5*b*, the outer cap (30), shown in FIG. 5*a* in a bottom perspective view and in FIG. 5*b* in a bottom view having cylindrical symmetry, comprises an inwardly facing upper surface (32) comprising a bolt member (34) depending therefrom. Although not shown in the figures that illustrate the first embodiment, the outer diameter of the bolt member (34) is preferably threaded in order to mate with the threaded inner surface (98) of the coupler (80), as described herein above (FIG. 2).

The outer cap (30) comprises blocking elements (36) protruding radially inward at the lower end (38') of inner surface (38) of the side wall of the outer cap (30). In the preferred embodiment, four blocking elements (36) are shown, however, any number thereof may be provided. An annular rib (not shown) is provided, protruding radially inward from the inner surface (38) of the side wall of the cap (30). When the container cover (10) is assembled, the outer cap (30) is placed over the inner shell (50), and is prevented from sliding upward and off the inner shell (50) by any suitable means such as an annular stopper (not shown in the figures that illustrate the first embodiment) protruding inward from the side wall of the inner shell (50), disposed above the annular rib.

Figure 6A:
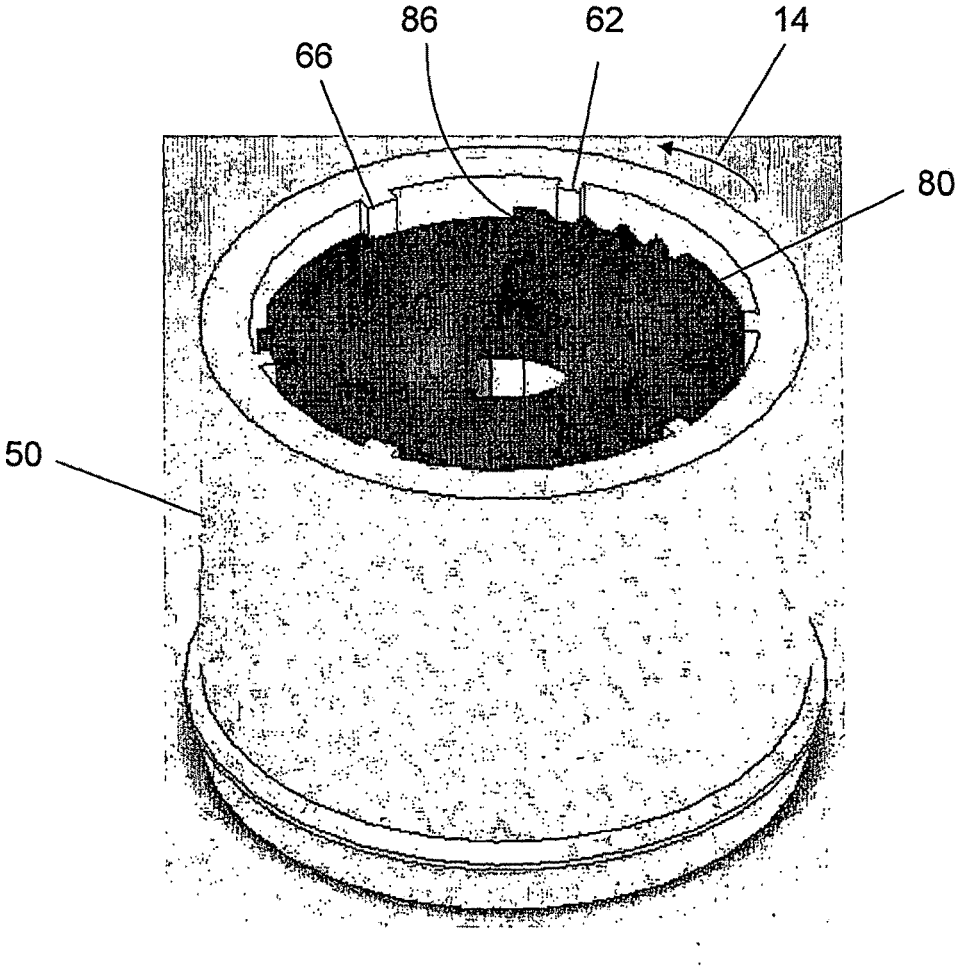
FIGS. 6*a* and 6*b* illustrate a perspective view of the first embodiment of the coupler of the present invention situated in the upper portion of the inner shell, wherein the coupler is in an initial position (FIG. 6*a*) and final position (FIG. 6*b*).
Figure 6B:
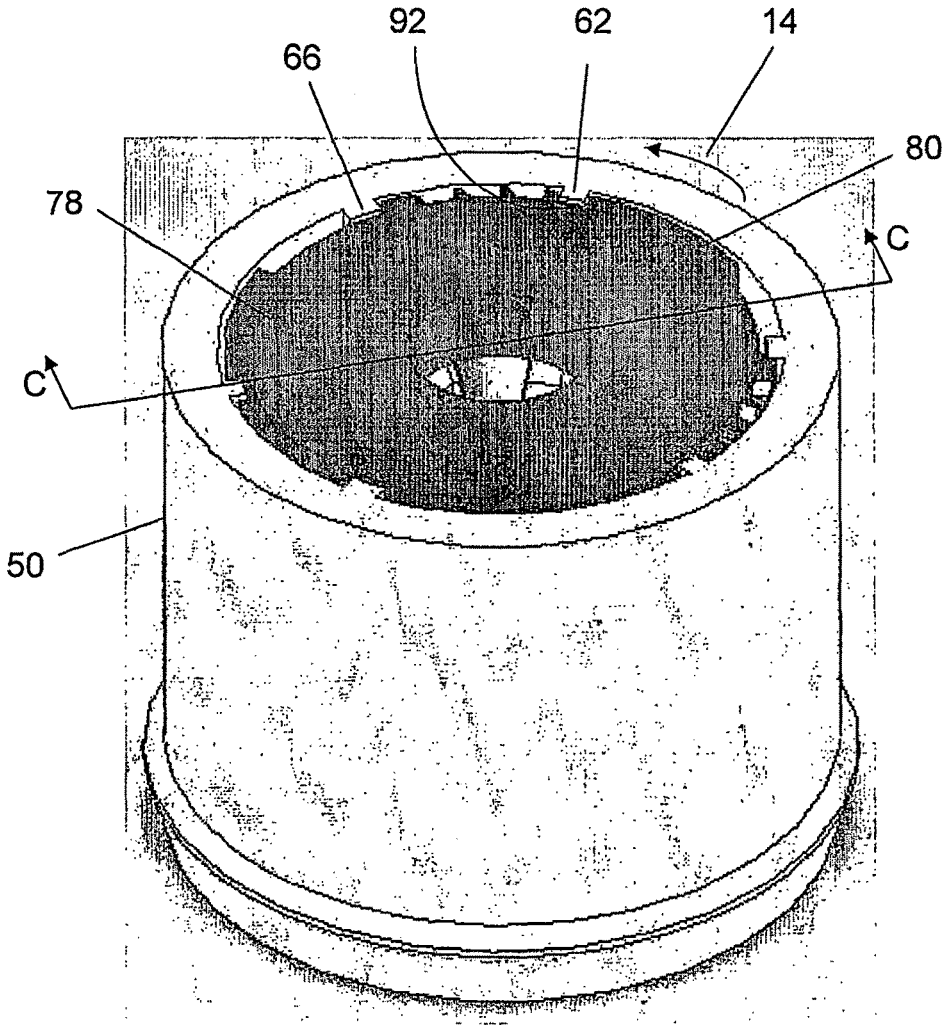

As shown in FIGS. 6*a* and 6*b*, when the container cover (10) is assembled, the coupler (80) is situated in the upper portion of the inner shell (50) as shown in FIGS. 6*a* and 6*b*. When positioning element (62) is lodged in first groove (86) (FIG. 6*a*), the coupler (80) is in the initial, or, locked position. In the locked position, retrograde rotation, as shown by arrow (14), of the inner shell (80) about the opening of a container (not shown) is hindered, as will be described herein below. When positioning element (62) of the coupler (80) is lodged in fourth groove (92) (see FIG. 6*b*), the coupler is in the final, or, unlocked position. In the unlocked position, retrograde rotation (14) of the shell (80) about the opening of a container is possible, as will be described herein below.

Figure 7:
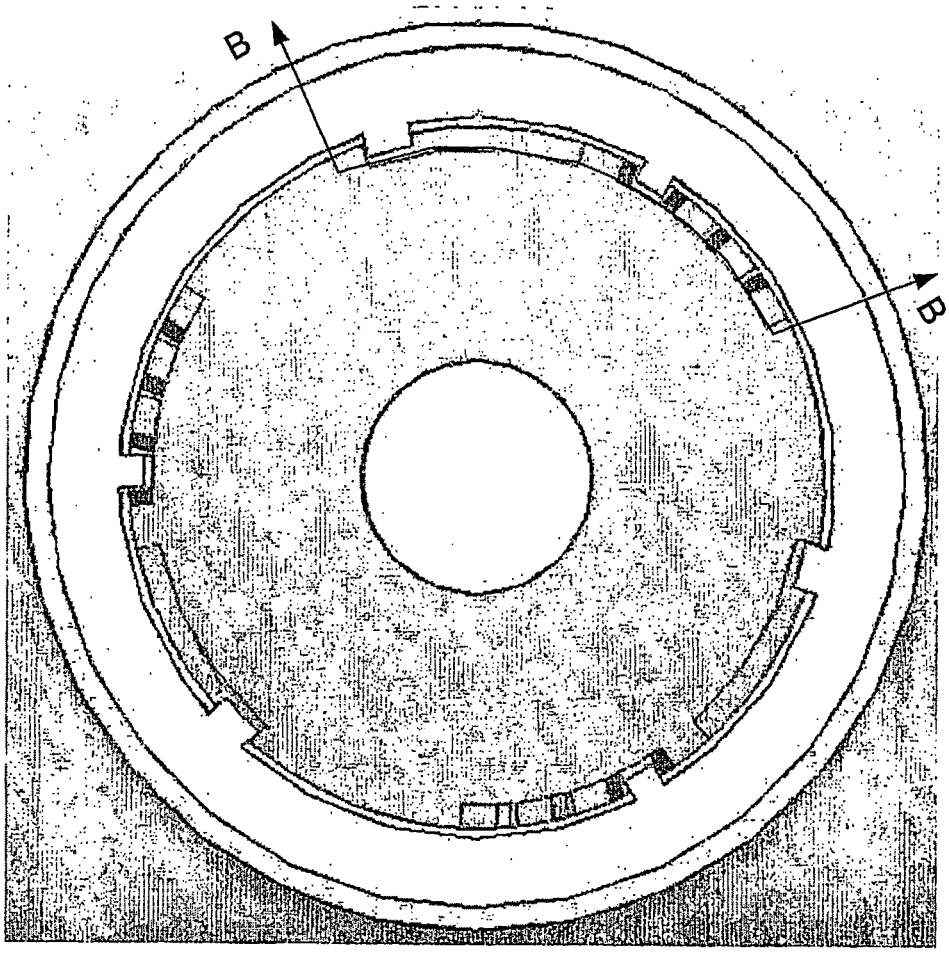
FIG. 7 illustrates a top view of the inner shell of the present invention, wherein the coupler situated in the upper portion, and wherein the coupler is in the initial position.

FIGS. 8*a* to 8*m* show the process by which the coupler shifts in a retrograde manner, shown by arrow (14), from the initial position (FIG. 8*a*) to final position (FIG. 8*m*) by applying a shaking motion to the container and cover assembly (10). The coupler (80) and inner shell (50) are shown in a cross-sectional side projection view, taken along B-B of FIG. 7.

Figure 8A:
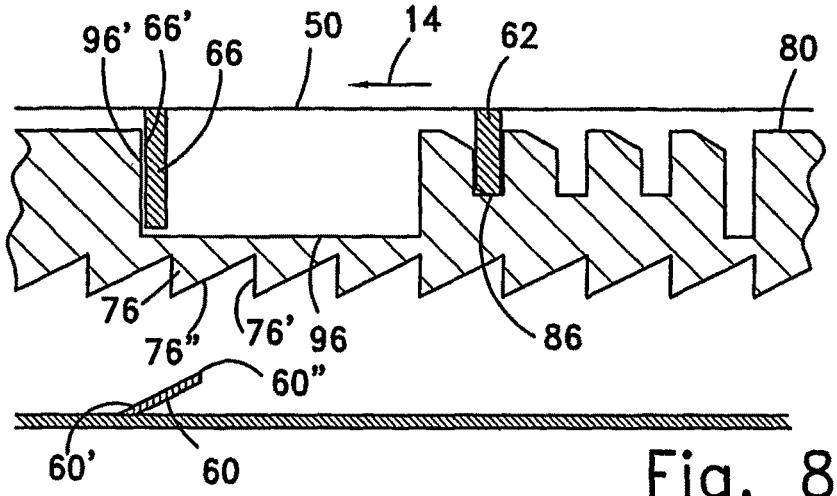
FIGS. 8*a* to 8*m* illustrate the first embodiment of the present invention showing the process of the coupler moving from an initial position (FIG. 8*a*) to a final position (FIG. 8*m*), in a cross-sectional side projection view, taken along B-B of FIG. 7.

In FIG. 8*a*, the coupler (80) is in the locked position. Spring members (100) (not shown in FIGS. 8*a*-8*m*, but seen FIGS. 3*a* and 3*b*) support coupler (80) such that positioning element (62) is lodged in first groove (86), and first side wall (66') of restricting element (66) essentially abuts first side wall (96') of radially recessed segment (96). Upon applying a shaking motion, spring members (100) compress inward (see FIG. 3*b*), thereby allowing coupler (80) to drop, as indicated by downward arrow (16) (FIG. 8*b*) until contact is made between the angled wall (76") of sawtooth (76) and the free end (60") of inclined stopper (60). After contact with the inclined stopper (60) is made, coupler (80) drops further (FIG. 8*c*), shifting toward the fixed end (60') of the inclined stopper (60) as indicated by arrow (18), and continues until the free end (60") of the inclined stopper (60) contacts the orthogonal wall (76') of adjacent sawtooth (76). As a result, as seen in FIG. 8*c*, second groove (88) is disposed such that at least a portion of the chamfered portion (89) of the first side wall (88') of second groove (88) is situated below at least a portion of the chamfered portion (61) of the first side wall (62') of positioning element (62). As seen in FIG. 8*c*, radially recessed segment (96) is relatively displaced such that restricting element (66) is spaced a predetermined distance from first side wall (96'). Referring to FIG. 8*d*, when compressed spring elements (not shown) expand, coupler (80) is forced upward as indicated by upward arrow (20), essentially orthogonal to partition (56), until chamfered portion (89) of first side wall (88') of second groove (88) contacts chamfered portion (61) of positioning member (62). Referring to FIG. 8*a*, spring members (not shown) further force coupler (80) upward and to slide along the chamfered portion of positioning element (62), as indicated by arrow (22) until positioning element (62) is lodged in second groove (88).

The steps shown in FIGS. 8*a* to 8*e* are repeated (FIGS. 8*f*-8*i*) by applying an additional shaking motion, such that positioning element (62) is lodged in third groove (90) (FIG. 8*i*), *mutatis mutandis*, and then repeated again (FIGS. 8*j*-8*m*) by applying a further additional shaking motion such that positioning element (62) is lodged in fourth groove (92) (FIG. 8*m*), *mutatis mutandis*. In FIG. 8*m*, when the coupler (80) is in the unlocked position, second side wall (66") of restricting element (66) essentially abuts second side wall (96") of radially recessed segment (96). In the position shown in FIG. 8*m*, no further retrograde rotation (14) of the coupler (80) is possible even if an additional shaking motion is applied. This may be understood from FIG. 9, wherein the position of coupler (80) is shown after a further shaking motion is applied when the coupler (80) is in the final position (FIG. 8*m*). Since the length of restricting element (66) is greater than that of positioning element (62), if coupler (80) is shifted downward, as indicated by arrow (16) and positioning element (62) is fully dislodged from fourth groove (92), the lower portion (66*a*) of the restricting element (66) remains partially disposed within radially recessed segment (96), thereby obstructing further retrograde rotation (14) and/or downward shifting of the coupler (80).

Figure 11:
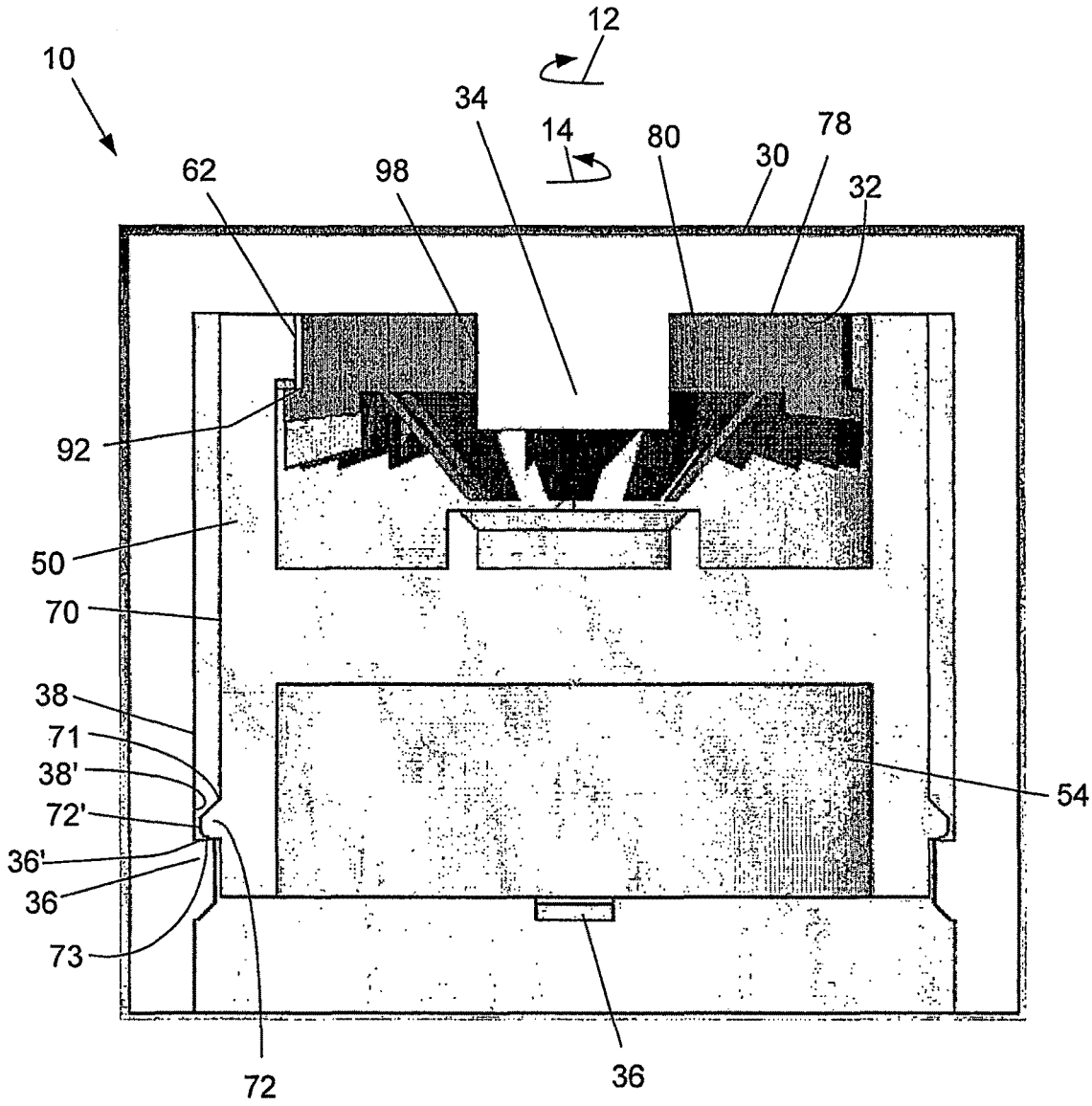
FIG. 11 illustrates the view shown in FIG. 10, following rotation of the outer cap.

In order to remove the cover assembly (10) from the container, the outer cap (30) must be rotated as described herein below. FIG. 10 shows a cross-sectional view taken along C-C of FIG. 6*b*, when the coupler (80) is in the final position. In the final position, the upper face (78) of the coupler (80) is essentially planar with the upper end (48') of the inner shell (50), and the bolt member (34) is aligned with the inner surface (98) of the coupler. When the bolt member (34) of the outer cap (30) engages inner surface (98), outer cap (30) is rotated in a retrograde direction (14) such that bolt member (34) threadingly mates with inner surface (98), until the inwardly facing upper surface (32) of the outer cap (30) is essentially in contact with upper face (78) of coupler (80) (FIG. 11). Thus, the outer cap (34) is lockingly engaged to inner shell (50) through coupler (80).

As seen in FIG. 10, prior to rotation of the outer cap (30), blocking elements (36) are disposed above rib (72), and following the rotation of the outer cap (30), as seen in FIG. 11, blocking elements (36) are disposed below rib (72). During rotation of the outer cap (30), blocking elements (36) slide downward along the outer surface (72') of rib (72) until blocking elements (36) are situated below rib (72) (see FIG. 11). The upper wall (71) of rib (72) is angled in order to allow blocking elements (36) to slide downward easily. The outer cap (30) and/or inner shell (50) is sufficiently flexible to allow a slight outward and/or inward bending thereto as blocking elements (36) slide over the rib (72). Lower wall (73) of rib (72) is essentially orthogonal to outer surface (70) of inner shell (50) and overlaps the upper wall (36') of blocking elements (36) in order to hinder upward motion of the outer cap (30) when blocking elements (36) are positioned below the rib (72). When cover assembly (10) is arranged in the position shown in FIG. 11, outer cap (30) is joined with inner shell (50) such that further retrograde rotation of the outer cap (30) causes the inner shell (50) to rotate in a retrograde direction about the opening of the container, until the cover (10) is no longer engaged with the open end of the container to which it was threadingly engaged, and may be removed therefrom.

When replacing the cover assembly (10) of the present invention on the open end of a container, the user rotates the cover assembly (10) in a forward direction (12) (FIG. 12) until inner shell (50) seals the open end of the container, and bolt (34) disengages from inner surface (98) of coupler (80), such that the outer cap (30) may rotate about its axis freely.

Figure 12:
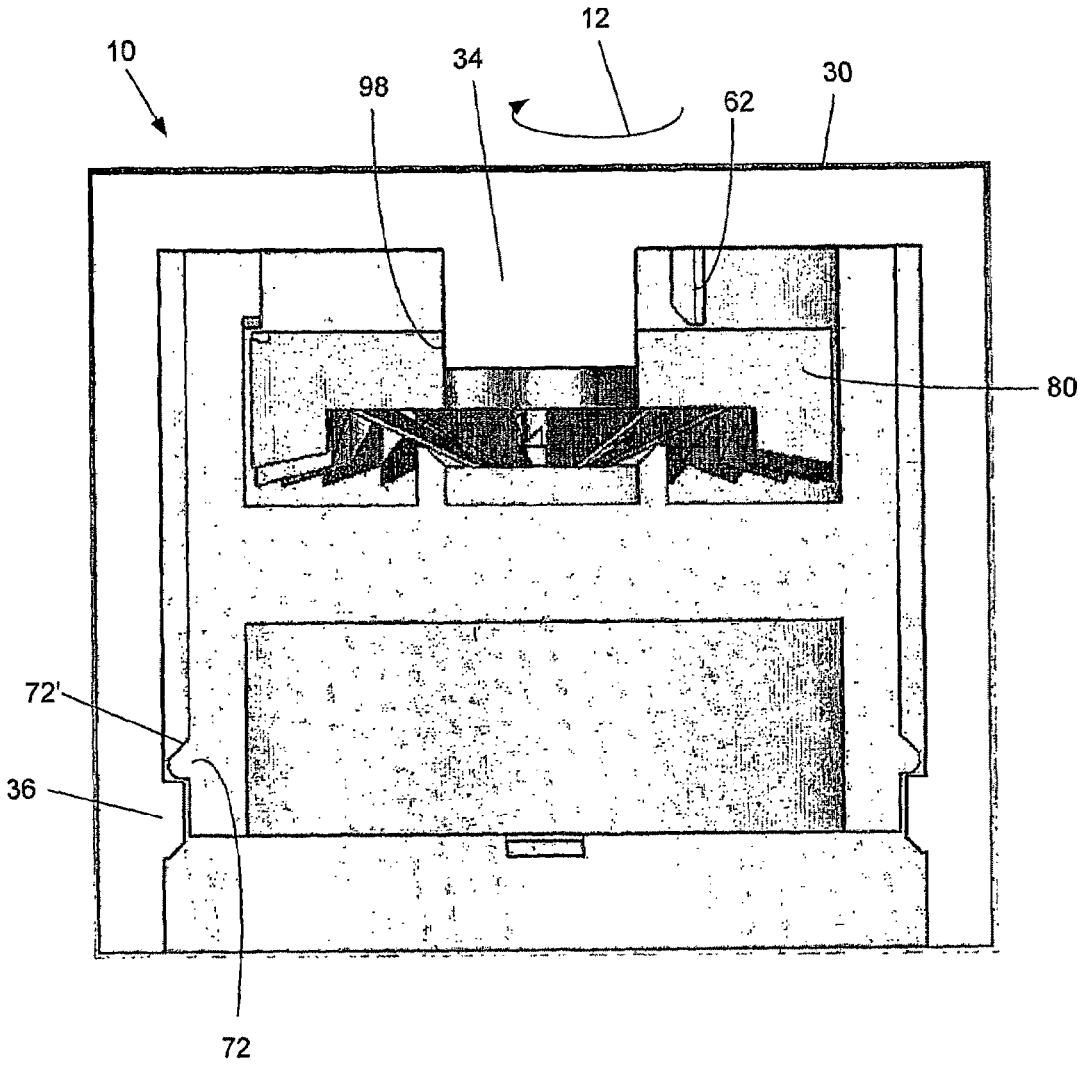
FIG. 12 illustrates one step in the process of returning the cover assembly of the present invention to the locked position, showing the view of FIG. 11 after the outer cap is rotated in a forward direction, until positioning element is dislodged from the groove.
Figure 13:
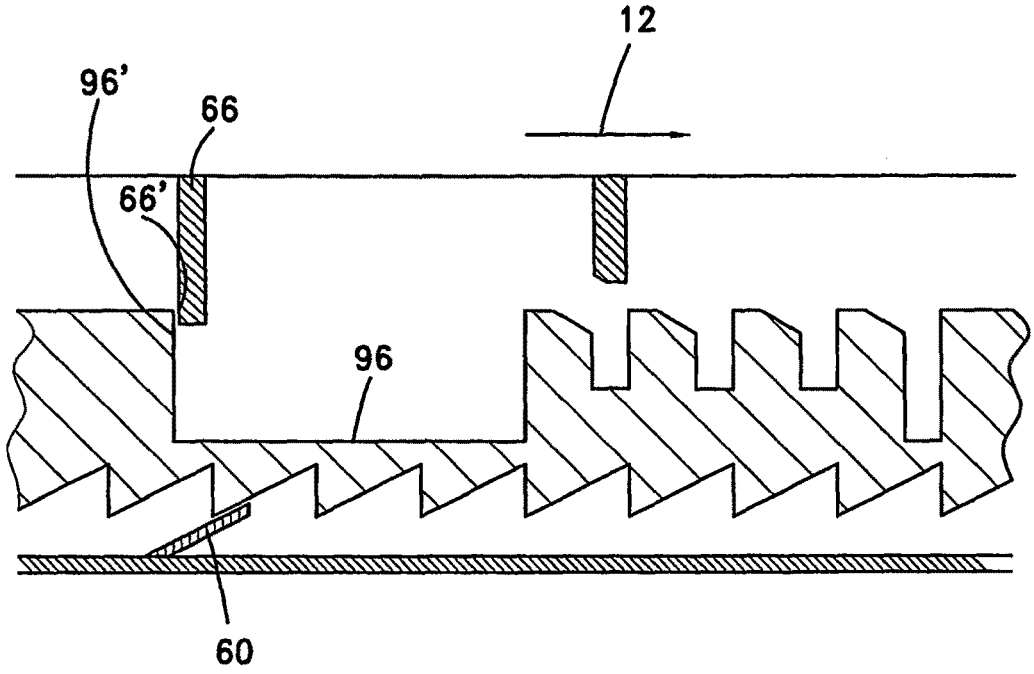
FIG. 13 illustrates the location of the positioning element and the restricting element with respect to the coupler after further forward rotation is applied following the position shown in FIG. 12.

The process by which the cover assembly (10) of the present invention returns to the initial, or, locked position is essentially the reverse of that described herein above regarding the removal of the cover assembly (10), *mutatis mutandis*, with the following differences. After the lower portion (54) of the inner shell (50) is placed on the open end of a container and outer cap (30) is rotated in a forward direction as described herein above, the components of the cover assembly (10) are essentially situated as shown in FIGS. 8*m* and 11. Positioning element (62) (FIG. 8*m*) is lodged in groove (92), and outer cap (30) and coupler (80) are engaged via bolt member (34). Blocking elements (36) of outer cap (30) are disposed under rib (72) of inner shell (50). Hence the outer cap (30) is unable to move upward. Rotating outer cap (30) in a forward direction (12) causes lower portion (54) (FIG. 11) of inner shell (50) to mate with the opening of a container, and causes the coupler (80) to rotate about the bolt member (34). When the coupler (80) rotates about the bolt (34) the coupler (80) shifts downward relative to the outer cap (30). The outer cap (30) is rotated in a forward direction until the positioning element (62) is dislodged from the fourth groove (92) (as seen in FIG. 12), but outer cap (30) and coupler (80) are still engaged by bolt member (34). Continuing to rotate the outer cap (30) in a forward direction (12) causes coupler (80) to further shift downward by rotating in a forward direction (12), until first side wall (66') of restricting element (66) contacts the first side wall (96') of radially recessed segment (96) (see FIG. 13).

As the outer cap (30) is rotated in a forward direction (12) as described herein above, the angled walls (76") of the sawteeth (76) contact inclined stoppers (60), which are made of a flexible material so as to allow the inclined stoppers (60) bend in the direction of the rotating coupler (80), thereby avoiding a disruption in the rotation of the coupler (80). Further rotation of the outer cap (30) causes coupler (80) to disengage from the bolt member (34) and blocking elements (36) of outer cap (30) are forced upward and slide along the outer surface (72') of the rib (72). Spring members (100) cause coupler (80) to shift upward, and positioning element (62) is lodged in first groove (86), i.e. the coupler is in the initial/locked position (see FIG. 8*a*).

Figure 8B:
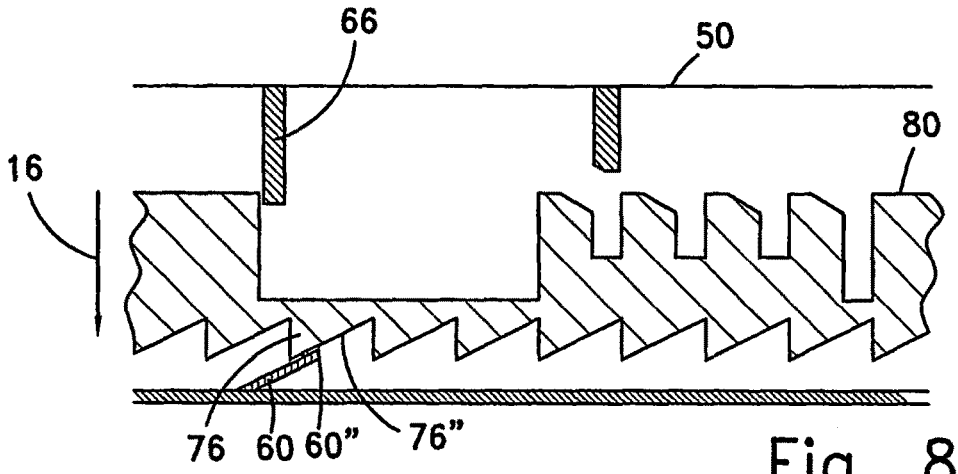
Figure 8C:
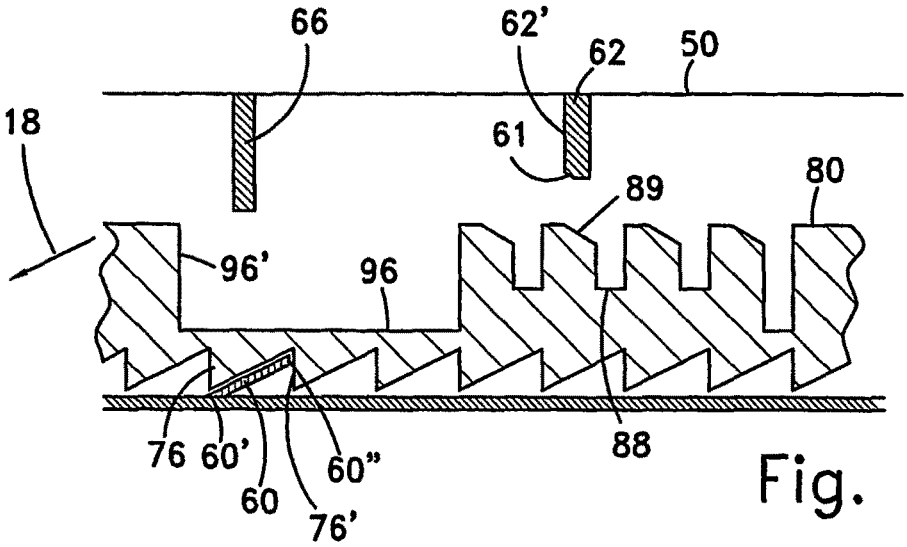
Figure 8D:
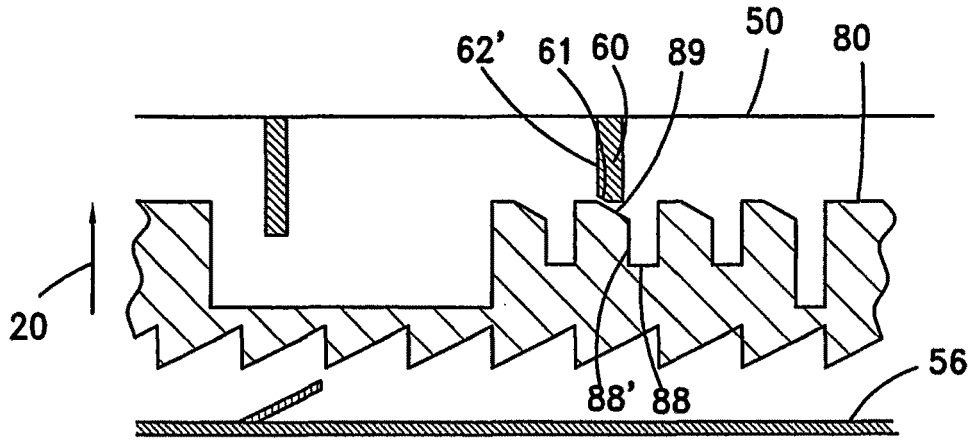
Figure 8E:
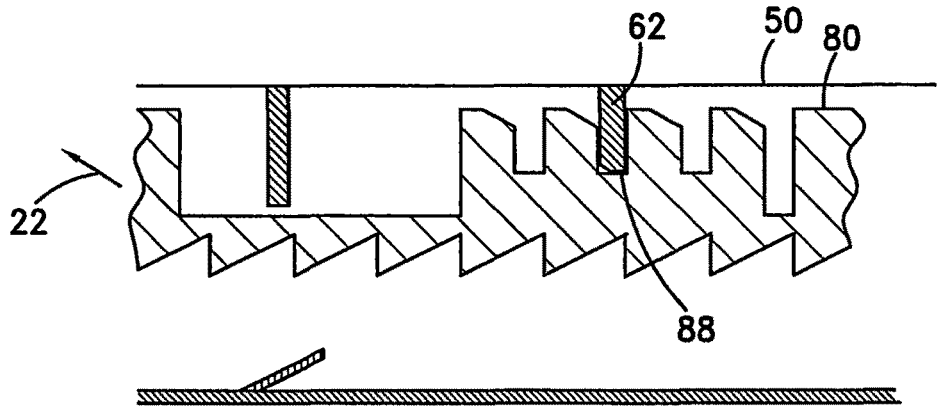
Figure 8F:
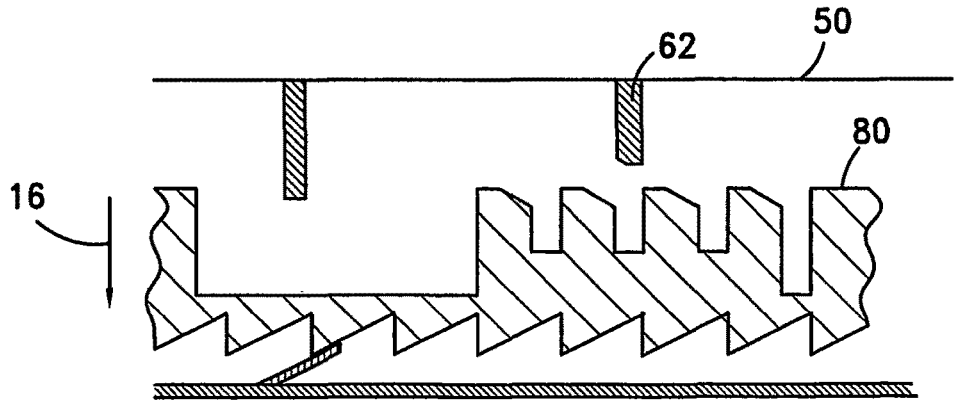
Figure 8G:
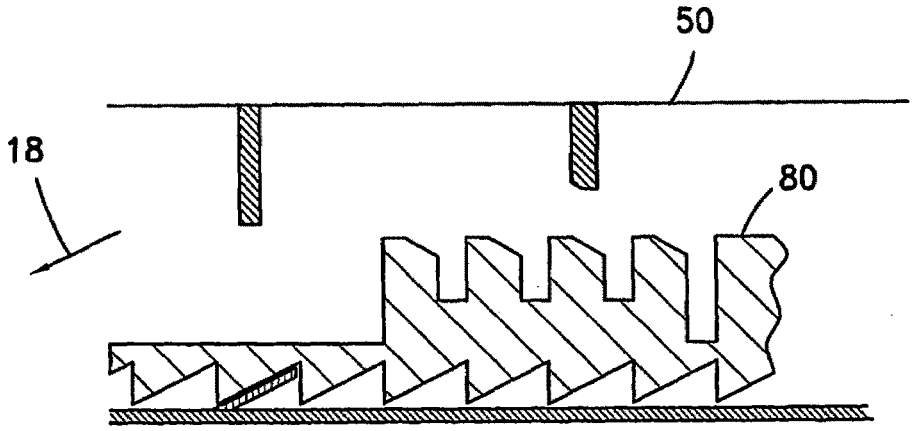
Figure 8H:
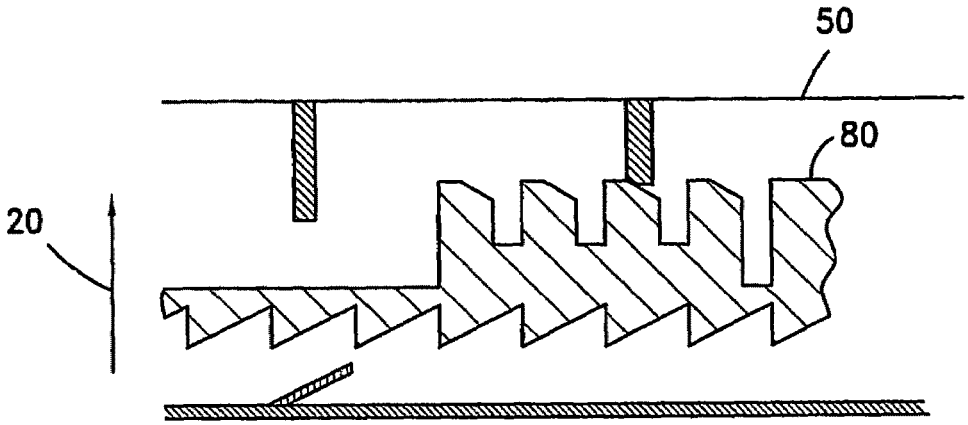
Figure 8I:
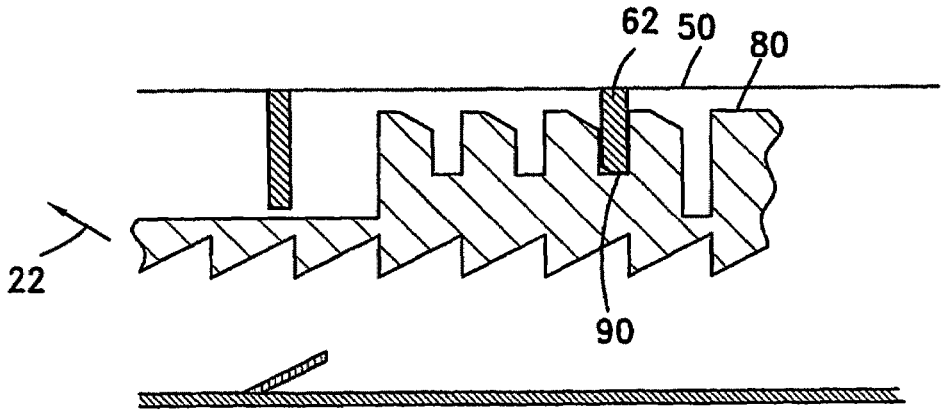
Figure 8J:
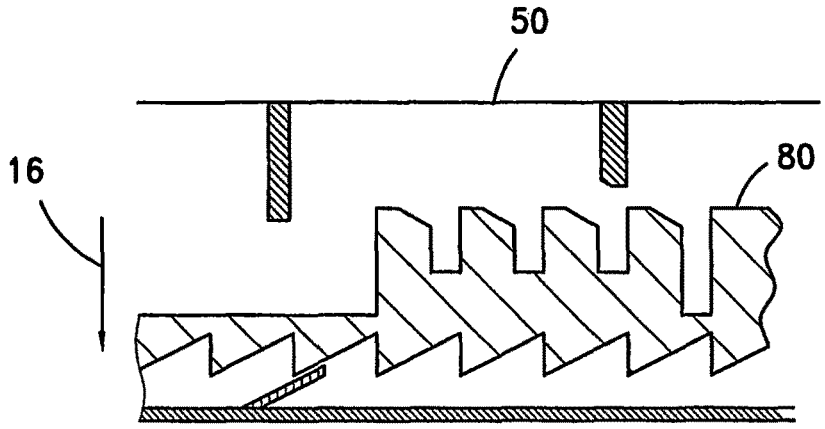
Figure 8K:
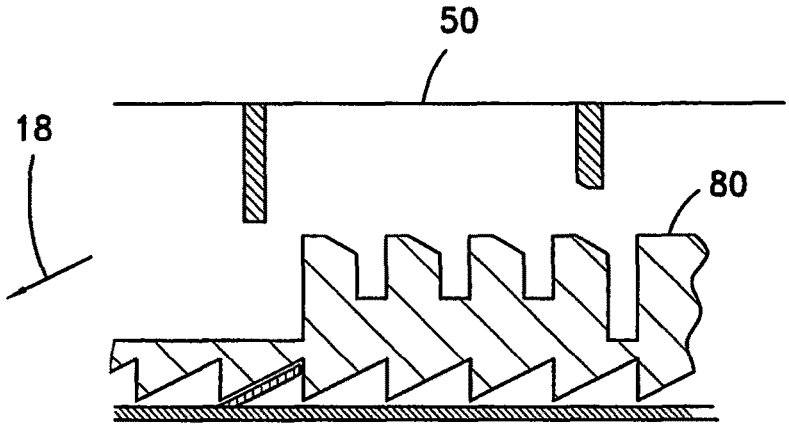
Figure 8L:
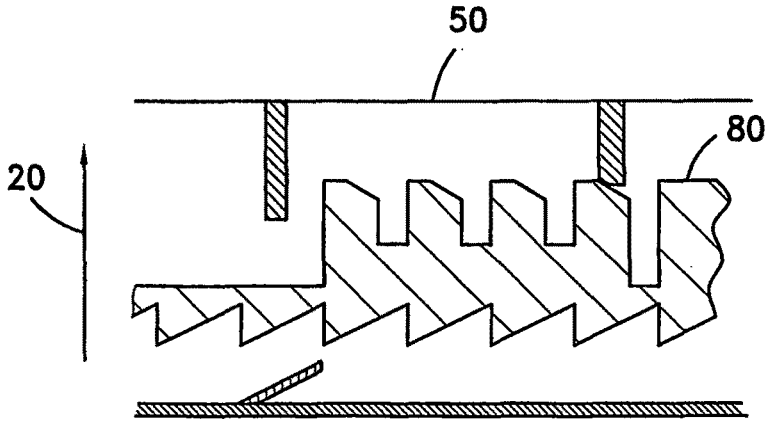
Figure 8M:
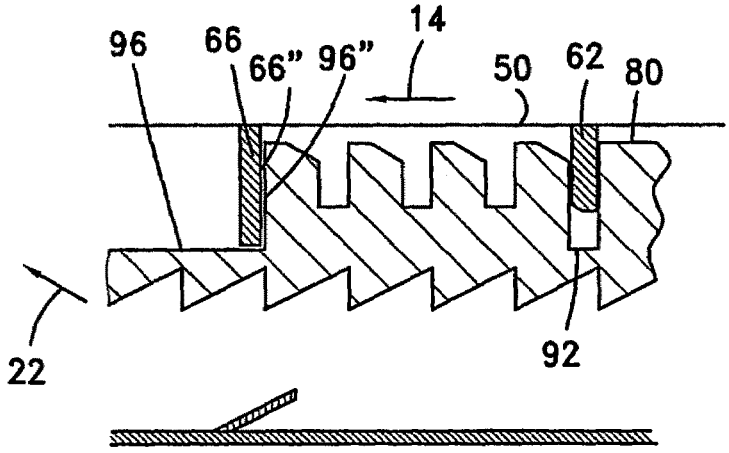
Figure 9:
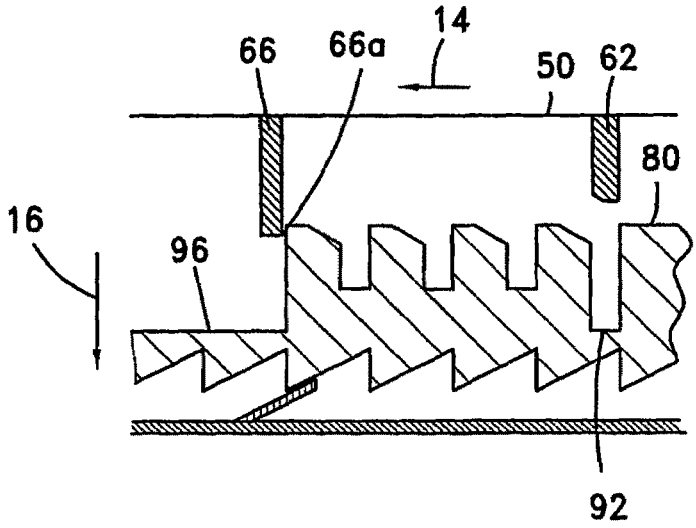
FIG. 9 illustrates a continuation of the process shown in FIGS. 8*a* to 8*m*, whereby an additional shaking motion is applied.
Figure 14:
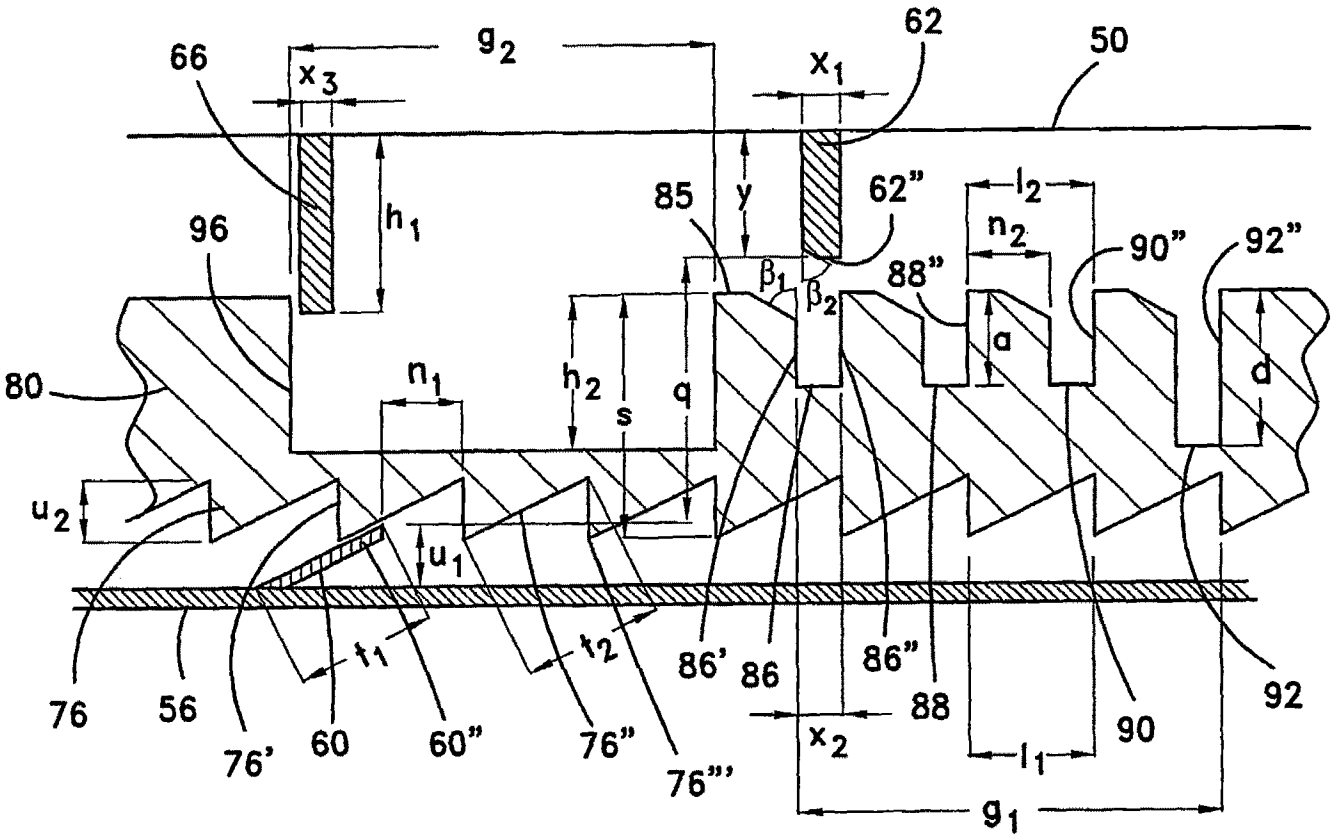
FIG. 14 illustrates the view of FIG. 8*c*, showing at least some of the critical dimensions of the first embodiment of some of the features of the present invention.

FIG. 14 is a cross-sectional side projection view as seen in FIG. 8*b*, showing the positioning element (62), restricting element (66) and inclined stopper (60) of the inner shell (50), as well as grooves (86), (88), (90), (92) and radially recessed segment (96) of the coupler (80), depicting some of the critical dimensions of a preferred embodiment of the present invention. The perpendicular distance ($u_1$) between the partition (56) of the inner shell (50) and the upper tip of the free end (60") of inclined stopper (60) is greater than or equal to the length ($u_2$) of orthogonal wall (76') of sawtooth (76), or, $u_1 \geqq u_2$. Length ($t_1$) of inclined stopper (60) is greater than or equal to length ($u_2$), and less than or equal to length (t2) of angled wall (76") of sawtooth (76), or, $t_2 \geqq t_1 \geqq u_2$. Distance ($l_1$) between lower tips of each sawtooth (76) is equal to the distance ($l_2$) between adjacent second side walls of two grooves, for instance, between second side walls (88") and (90"), or, $l_1 = l_2$. The distance ($n_1$) from the orthogonal wall (76') of a sawtooth (76) to the location along the angled wall (76") of a sawtooth (76), below which the upper tip of the free end (60") of the inclined stopper (60) is situated when positioning element (62) is lodged in (or disposed above) any groove is essentially equal to the distance ($n_2$) between the second side wall of a groove, for instance, second side wall (88"), and the adjacent first side wall of an adjacent groove, for instance, (90"), or, $n_1 = n_2$. Length (d) of the longest groove (92) is greater than length (a) of each other groove, or, d>a. The width ($x_1$) of the positioning element (62) is essentially equal to, but slightly less than, the width ($x_2$) of each of the grooves, in order to facilitate positioning element (62) to be lodged snuggly into each groove. Chamfered angle ($\beta_1$) of the upper end of first side wall of each groove is preferably essentially equal to chamfered angle ($\beta_2$) of the lower end of the first side wall of each positioning element (62) in order to facilitate ease of sliding of positioning element (62) into grooves, or, $\beta_1 = \beta_2$. Length ($h_1$) of restricting element (66) is greater than or equal to length ($h_2$) of radially recessed segment (96), or, $h_1 \geqq h_2$. Furthermore, the length ($h_1$) is greater than the length (y) of the positioning element (62), or, $h_1 > y$. The distance ($g_1$) between the first side wall (86') of first groove (86) and second side wall (92") of last groove (92) is less than or equal to the width ($g_2$) of the radially recessed segment (96), or, $g_1 \leqq g_2$, and width ($x_3$) of restricting element (66) is greater than or equal to width ($x_1$) of positioning element (62), or, $x_3 \geqq x_1$, wherein $(g_2 - x_3) = (g_1 - x_1)$. Finally, the distance (q) between the lower wall (62") of positioning element (62) and the upper tip of the free end of inclined stopper (60) is greater than the distance (s) between the upper edge (85) of the grooves and the lower tip (76'") of a sawtooth (76), by preferably a small amount, or, q>s, but less than the difference between length ($h_1$) and length (y), or, $(q-s) < (h_1 - y)$.

Figure 15:
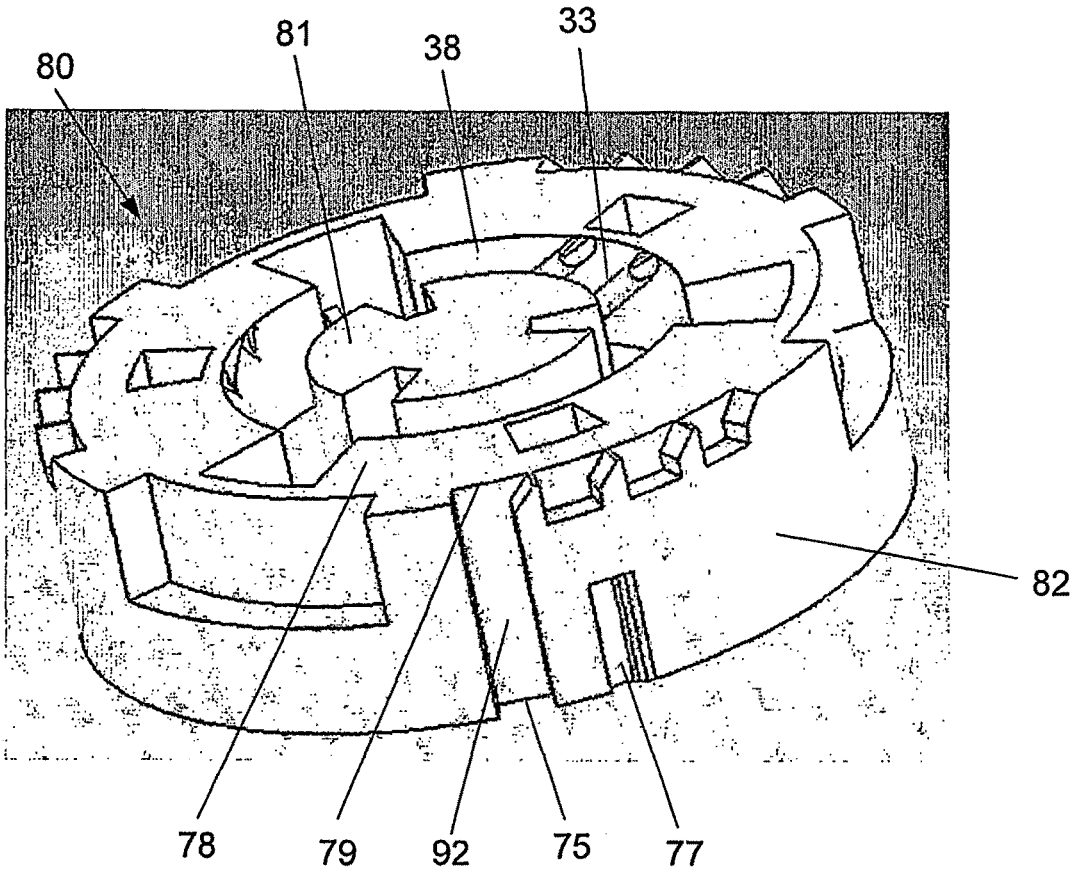
FIG. 15 illustrates the coupler of the second embodiment in a top perspective view

A second embodiment of the present invention is shown in FIGS. 15-24, and comprises all of the elements of the first embodiment, as described herein above, *mutatis mutandis*, with the following differences. Referring to FIG. 15, showing the coupler (80) in a top perspective view, the fourth groove (92) of the coupler (80) extends from the edge (79) of the upper face (78) entirely along the outer surface (82) to the lower edge (75), thereby creating a through path in the outer surface (82) of the coupler (80) for the positioning element (62) (not shown) to slide therein.

Figure 16:
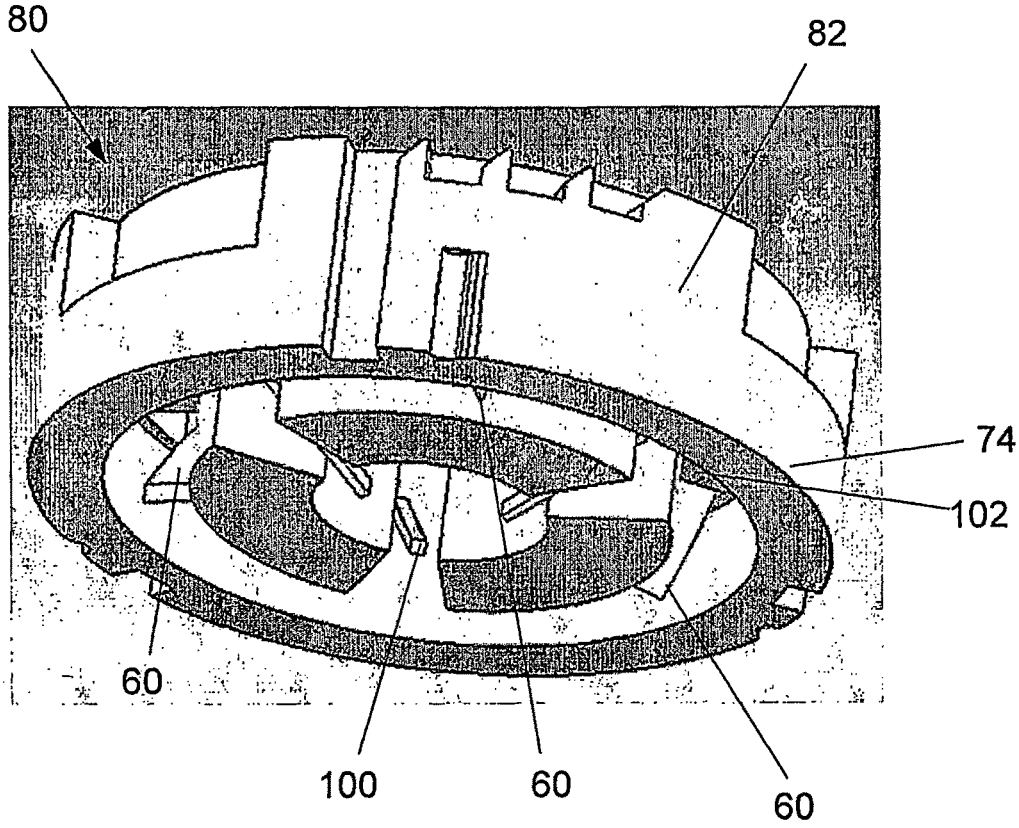
FIG. 16 illustrates the coupler of the second embodiment in a bottom perspective view.
Figure 17:
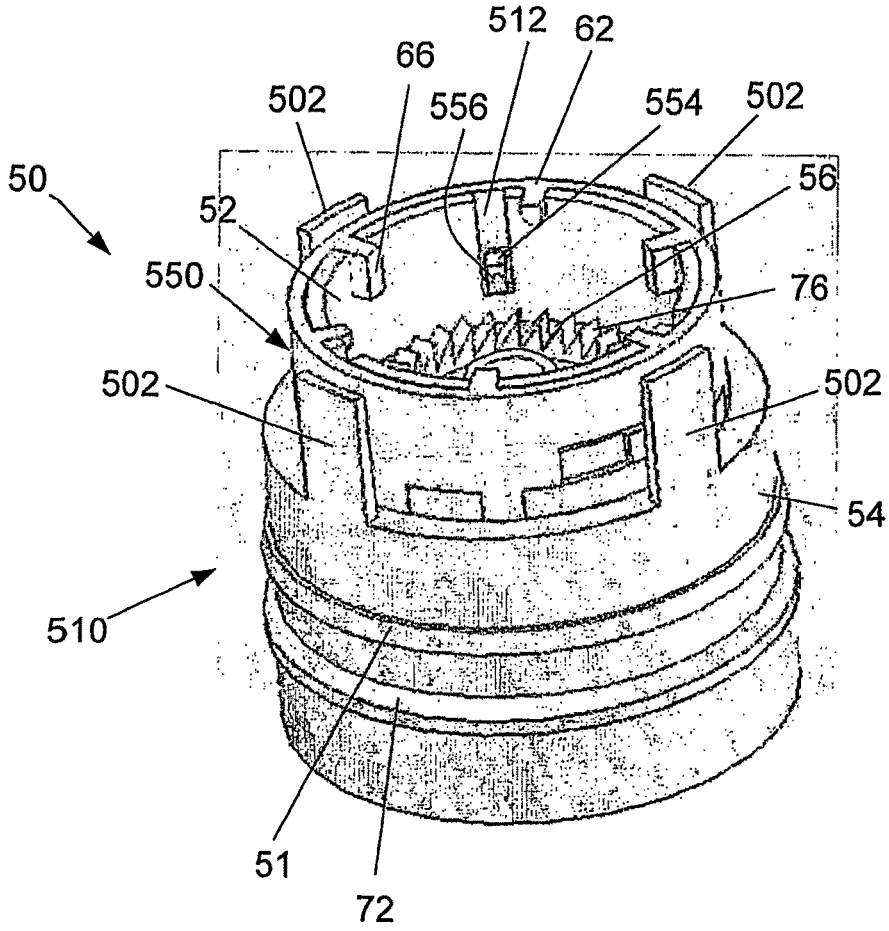
FIG. 17 illustrates the inner shell of the second embodiment in a top perspective view.

According to the second embodiment, and as best seen in FIG. 16 showing a perspective view of the bottom of the coupler (80), the lower end (74) of the outer surface (82) of the coupler (80) terminates in essentially an annular surface. This is in contrast to the lower end (75) of the coupler (80) of the first embodiment, which comprises an array of sawteeth (76) (shown in FIG. 2). The inclined stoppers (60) depend from the lower face (102) of the coupler (80). As seen in FIG. 17, showing a top perspective view of the inner shell (50), sawteeth (76) project upward from the upper face of the partition (56). The relative motion between the sawteeth (76) and the inclined stoppers (60) as described herein above for the first embodiment regarding the process by which the coupler (80) shifts in retrograde and forward directions between initial and final positions, is essentially the same as that for the second embodiment, *mutatis mutandis.*

Referring to FIG. 16, spring members (100) are shown comprising an array of three elongated members (100), depending on an incline from the lower face (102). Referring to FIG. 15, internal thread (33) is situated at the inner surface (38) of the coupler (80) for allowing the bolt member (34) (not shown in this figure) to threadingly mate with the coupler (80).

Figure 18:
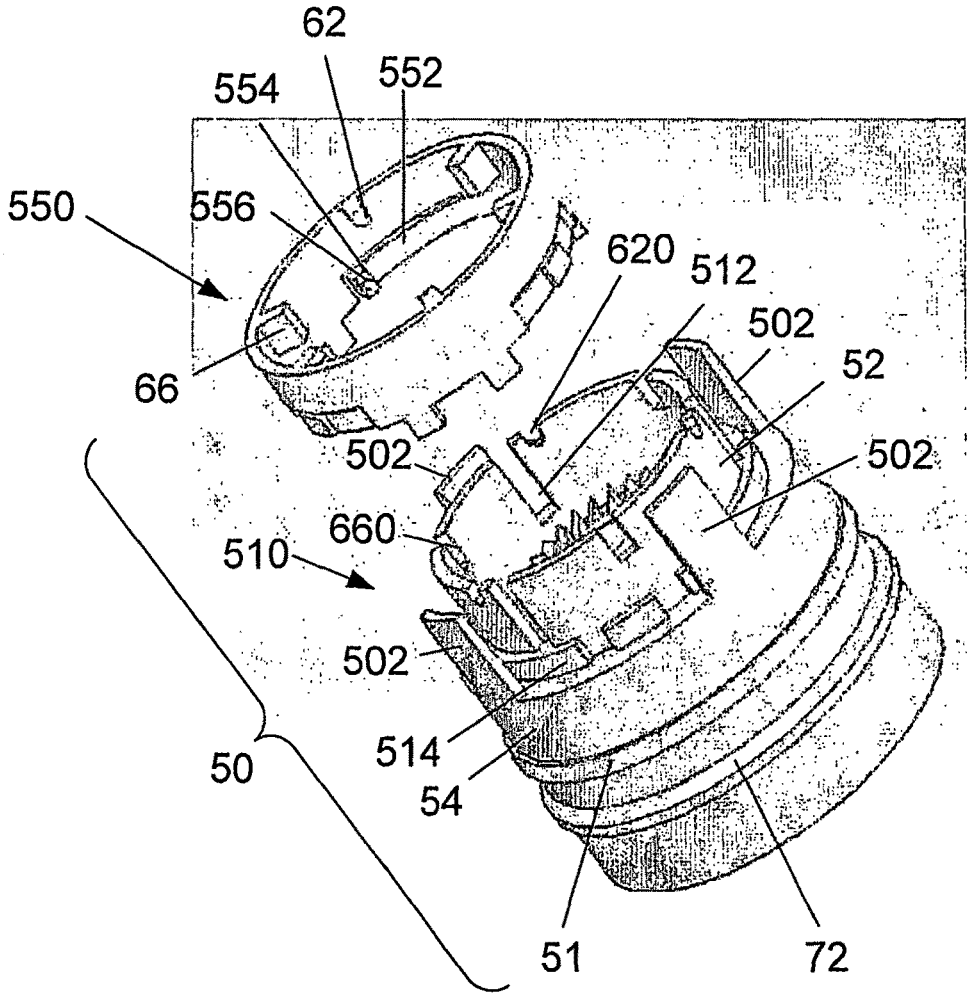
FIG. 18 illustrates the inner shell of the second embodiment in an exploded view.

As seen in FIG. 18, the components of the inner shell (50) of the second embodiment are shown in an exploded view, and are comprised of the shell portion (510) and the ring portion (550), wherein when assembled (FIG. 17), the ring portion (550) is situated around the perimeter of the upper portion (52) of the shell (50). The ring portion (550) comprises positioning elements (62) and restricting elements (66), as described herein above with respect to the first embodiment, *mutatis mutandis*, and the side wall of the upper portion (52) of the inner shell (50) comprises suitable openings (620) and (660) for positioning elements (62) and restricting elements (66) to respectively be disposed therein, as seen in FIG. 17.

Referring to FIGS. 17 and 18, the side wall of the upper portion (52) further comprises an opening (512) for allowing the head (554) of the spring stopper (552) to be disposed therein, as described herein below.

The configuration of the inner shell (50) according to the second embodiment, wherein the inner shell (50) is comprised of two components, is mainly due to manufacturing considerations, however, structural advantages that may arise from such an arrangement should be considered aspects of the present invention.

One advantage associated with the second embodiment of the present invention is the addition of elements such as the spring stopper (552) and spring groove (77), which further prevent a user from being able to remove the cover assembly (10) from the container without applying a shaking motion. A cover assembly (10) that does not comprise these additional elements (e.g. the cover assembly of the first embodiment) may be removed from a container by applying a large downward force to the cap (30) when the coupler (80) is in the locked position, and rotating the cap (30) such that the bolt member (34) engages with the coupler (80). In turn, the inner shell (50) engages with outer cap (30) via the coupler (80). Further rotating the cover assembly (10) causes the inner shell (50) to rotate about the opening of the container until the cover assembly (10) may be removed from the opening of the container. Hence, the application of a shaking motion which causes the rotation of the coupler (80) from the initial to the final position is bypassed. However, according to the second embodiment, until the coupler (80) is in the final position, the spring stoppers (552) prevent the bolt member (34) from engaging with the coupler (80), even if a large downward force is applied to the outer cap (30).

Figure 19A:
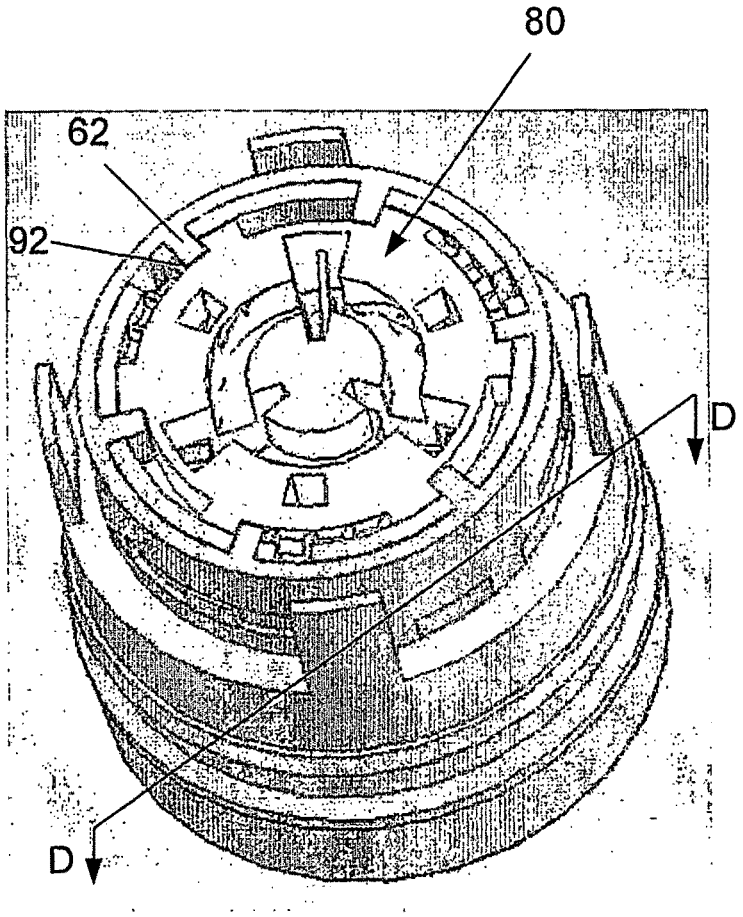
FIGS. 19*a* and 19*b* illustrate a top perspective view of the coupler of the second embodiment situated within the inner shell of the second embodiment (FIG. 19*a*) and a cross-sectional view taken along D-D of FIG. 19*a* (FIG. 19*b*).
Figure 19B:
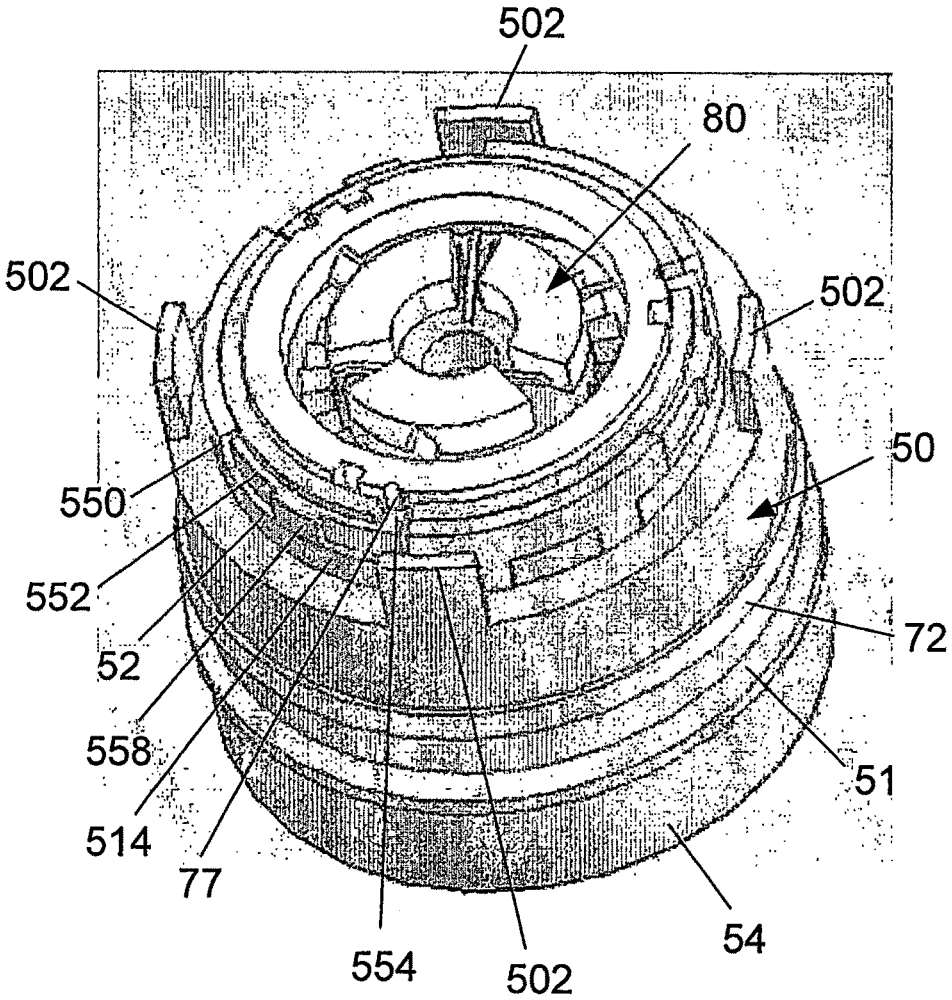

FIG. 19*a* shows the coupler (80) in the final position, wherein the positioning element (62) is lodged in the fourth groove (92). FIG. 19*b* shows a cross-sectional view taken along D-D of FIG. 19*a*. In the final position, the rounded protrusion (556) (FIGS. 17 and 18) extending inwardly from the head (554) of the spring stopper (552) is disposed in the spring groove (77) such that the outer surface of the stopper portion (558) lies along essentially the same circumferential plane as the outer surface of the ring portion (550), as well as along essentially the same circumferential plane as the outer surface of the lip (514) which radially protrudes from the lower end of the upper portion (52) of the inner shell (50).

Figure 20:
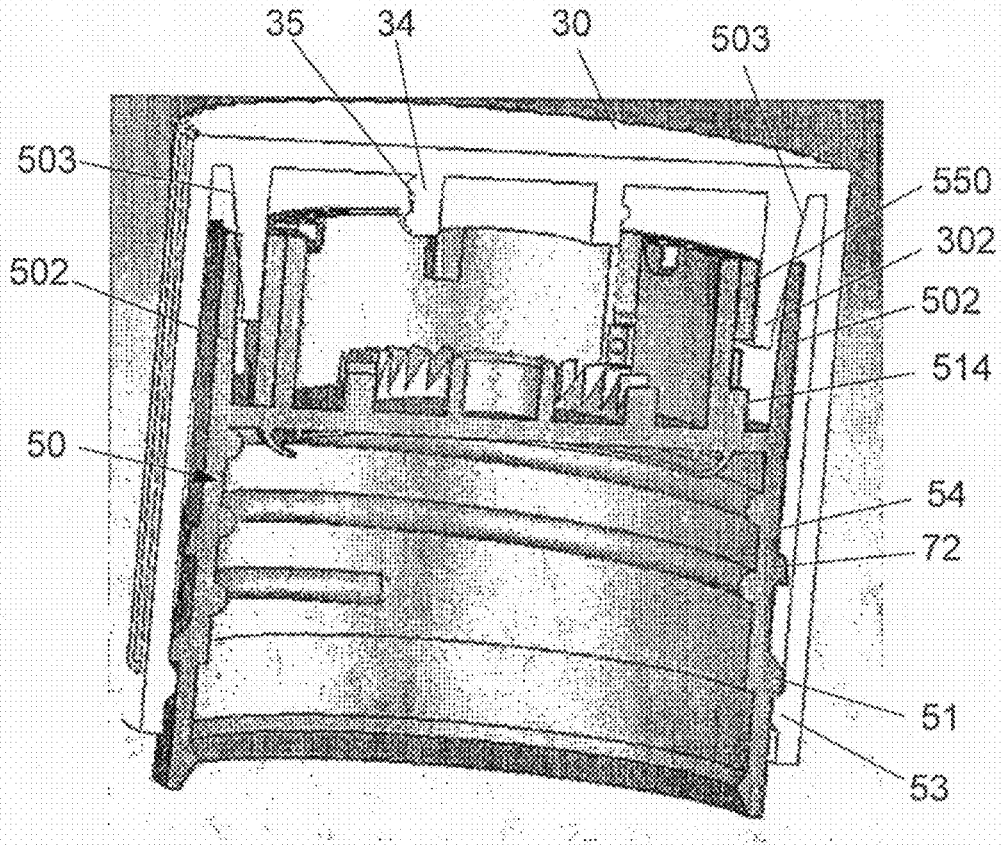
FIGS. 20 and 21 illustrate a cross-sectional perspective view of the inner shell and the outer cap of the second embodiment, when the coupler is in the final position, prior to rotating the outer cap (FIG. 20), and following the rotation of the outer cap (FIG. 21).
Figure 21:
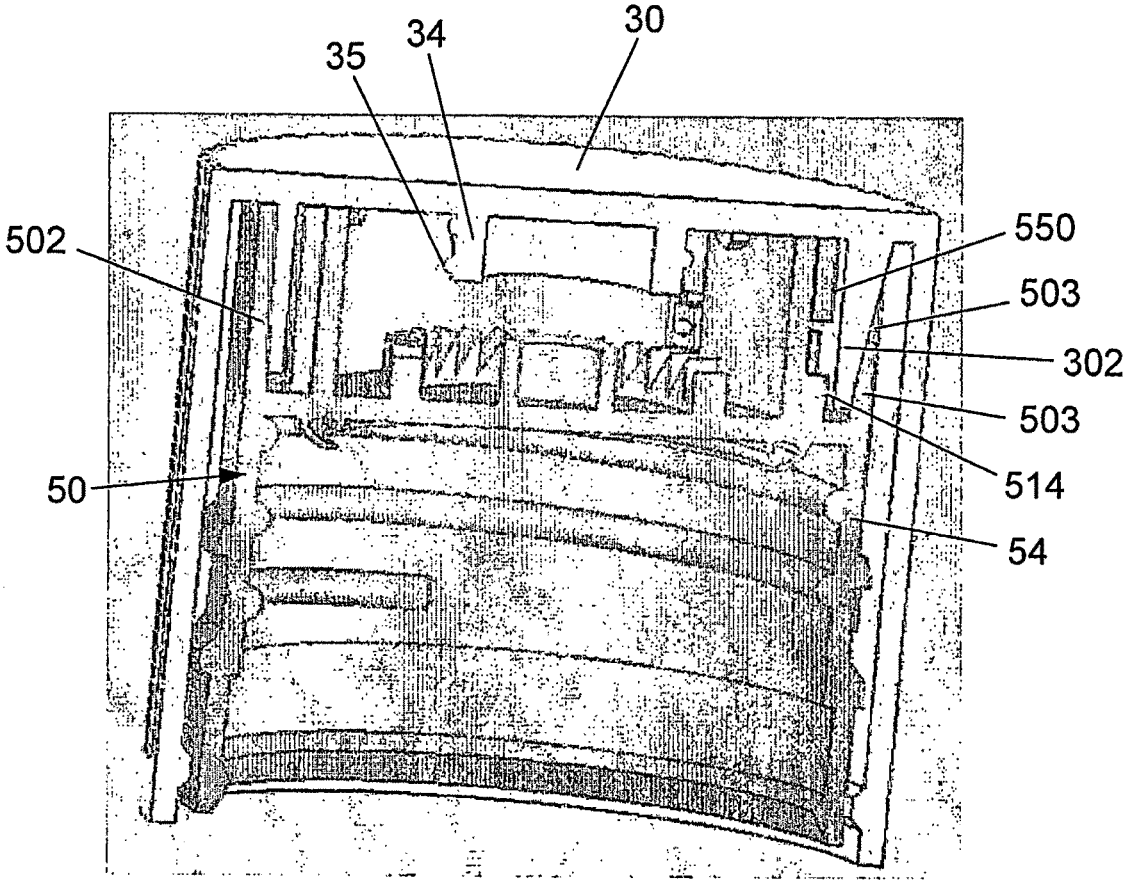

FIGS. 20 and 21 show a cross-sectional perspective view of the inner shell (50) and the outer cap (30) assembled thereon, when the coupler (80) (not shown in this figure for clarity) is in the final position. FIG. 20 shows the cover assembly (10) prior to rotating the outer cap (30) in a retrograde direction, and FIG. 21 shows the cover assembly following the rotation of the outer cap (30) in a retrograde direction, as described herein above for the first embodiment regarding FIGS. 10 and 11, *mutatis mutandis*. As described above and shown in the figures, the outer surfaces of the stopper portion (558) (not shown in FIGS. 20 and 21), the ring portion (550) and the lip (514) are situated along the same circumferential plane. Therefore, the depending cylinder (302) of the outer cap (30) may shift unobstructed from the position shown in FIG. 20 to the position shown in FIG. 21, when the outer cap (30) is pressed downward.

As seen in FIGS. 20 and 21, the bolt member (34) of the second embodiment comprises a hollow central portion for fitting over the central portion (81) (FIG. (15)) of the coupler (80). The external threading (35) of the central portion (34) mates with the internal threading (33) on the inner surface of the coupler (80).

Still referring to FIGS. 20 and 21, but also seen in FIGS. 17-19, a plurality of panels (502) (four in this embodiment) continue vertically upward from the outer wall of the lower portion (54) of the shell (50). The depending cylinder (302) is disposed between the panels (502) and the ring portion (550). Since the outer wall (503) of the cylinder (302) depends inward, the outer cap (30) is not able to rotatably shift from the position in FIG. 20 to that of FIG. 21 without providing a predetermined amount of force which causes the panels (502) to bend slightly outward (not shown in the figures). Thus, the panels (502) serve as a spring mechanism that for supporting the outer cap (30) via the depending cylinder (302) in the pre-rotated position (FIG. 20).

Figure 22:
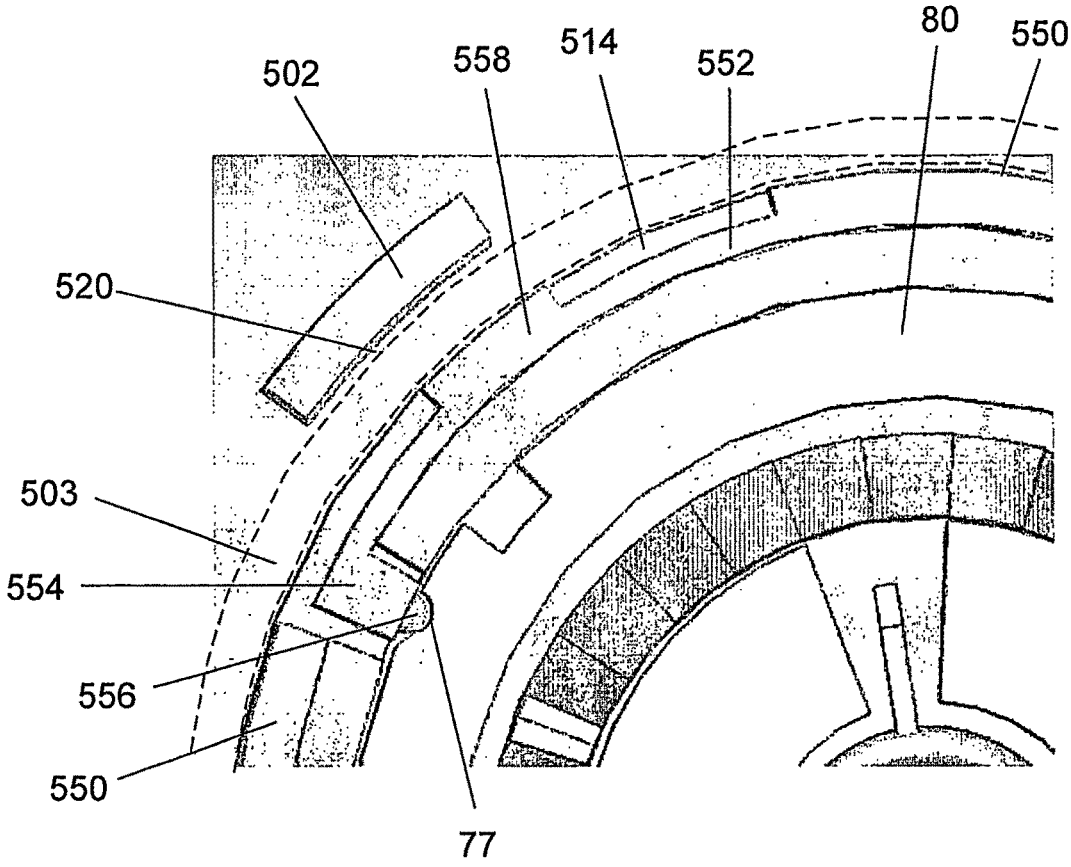
FIG. 22 illustrates a top view of a portion of the view shown in FIG. 19*b*, showing the spring stopper of the second invention.

A section of the view of the spring stopper (552), which is shown in a cross-sectional perspective view in FIG. 19*b*, wherein the coupler (80) is in the final position, is shown in a top view in FIG. 22. As described above, and seen in FIG. 22, when the coupler (80) is in the final position, the outer surface of the stopper portion (558), the ring portion (550) and the lip (514) are situated along the same circumferential plane. Thus, when the outer cap (30) (not shown in the figure) is pressed downward, is rotated, the depending cylinder (302), (shown in FIG. 22 by dotted lines), may shift unobstructed within the gap (520) between the ring portion (550) and the panels (502).

Figure 23:
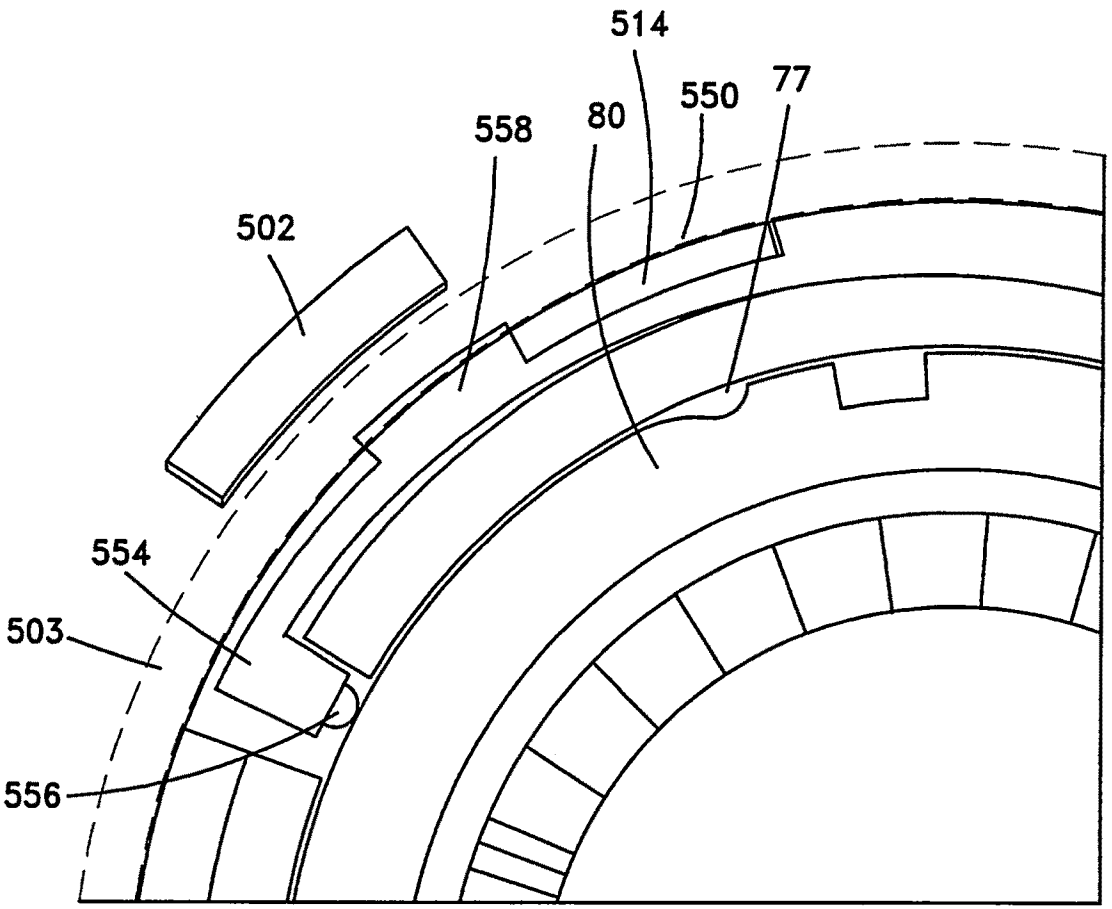
FIG. 23 illustrates the view shown in FIG. 22, wherein the coupler is in the initial position.

FIG. 23 shows a top view, similar to that shown in FIG. 22, however the coupler (80) in FIG. 23 is in the initial position. In the initial position, the rounded protrusion (556) extending from the head portion (554) is not lodged in the spring groove (77). Instead, rounded protrusion (556) is in contact with the outer surface of the coupler (80). The outer surface of the stopper portion (558) extends radially outward, overlapping the lip (514). Hence, If a user attempts to force the outer cap (30) (not shown) downward, the depending cylinder (503), (shown in the figure by dotted lines), is obstructed by the stopper portion (558).

Figure 24:
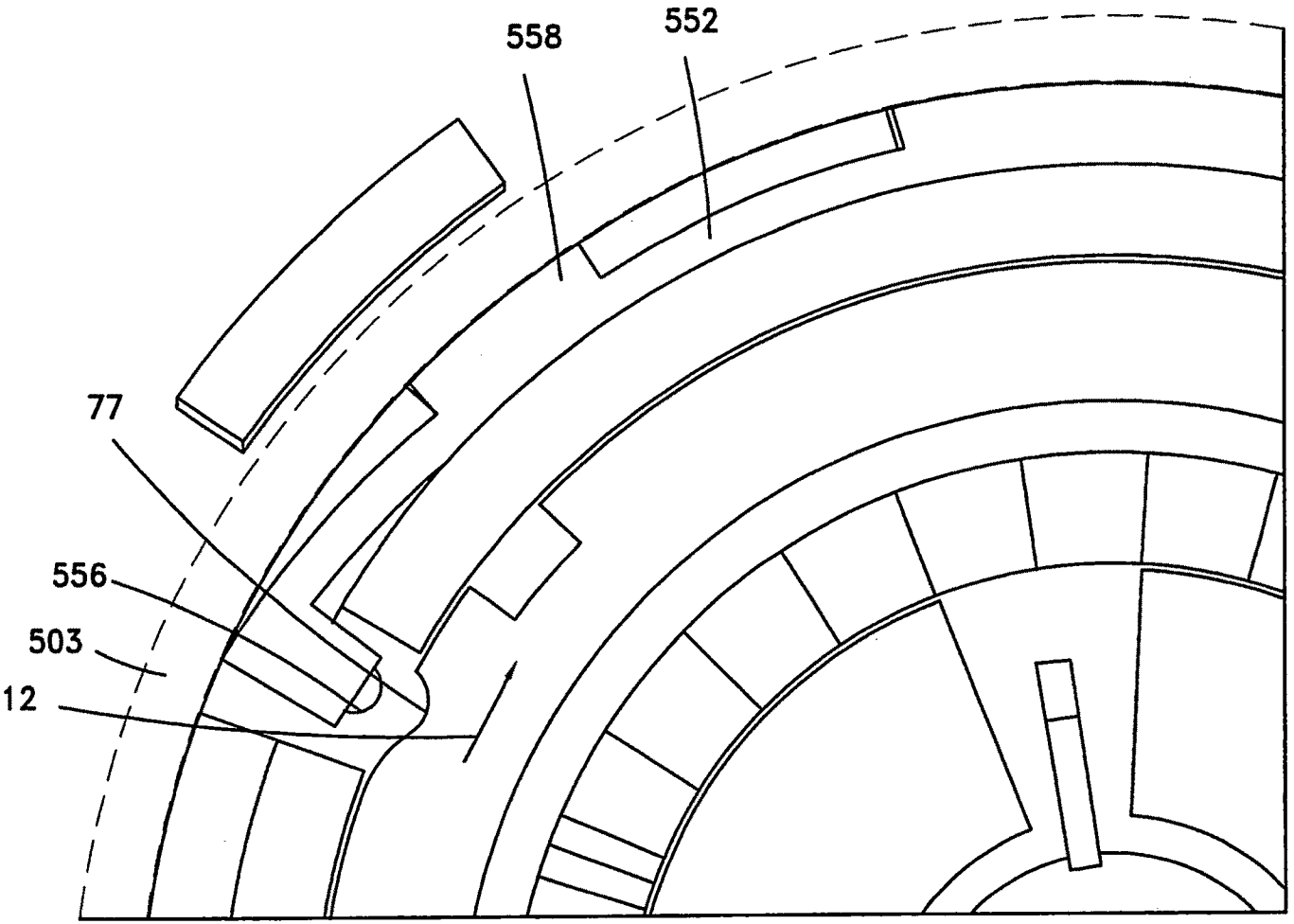
FIG. 24 illustrates the view shown in FIG. 22, wherein the coupler is rotated at a small angle, thereby urging the head portion of the spring stopper out of the spring groove.

Referring to FIG. 24, it is important to point out that when the depending cylinder (503), as indicated by dotted lines, is disposed in the gap (520) and the coupler (80) is rotated in a forward direction, as indicated by arrow (12), the stopper portion (558) is prevented from moving in an outwardly radial direction due to the depending cylinder (503). Thus, when the coupler (80) begins to rotate, the rounded portion (556) of the spring stopper (552) is urged out of the spring groove (77), as shown herein.

Referring to FIGS. 20 and 21 of the second embodiment, but equally applicable to the first embodiment, *mutatis mutandis*, the present invention provides the user with visual and physical indication of the state of the cover assembly. When the cover assembly is able to be removed from the container, as seen in FIG. 21, the lower end of the cap (20) is at least planar with, but may be even lower than the lower end of, the inner shell (50). The inner shell (50) is covered both visually and physically by the outer cap (30). As seen in FIG. 20, until the cover assembly is able to be removed from the container, the user may see or feel at least a portion of the lower end of the inner shell (50). The lower end of the shell (50) may contain indicia such as words (e.g. "locked" or "closed") or one or more colors indicating its state.

As described herein in the first embodiment but only shown in the figures of the second embodiment (see, in particular, FIG. 20), an annular stopper (51) protruding from the inner shell (50) is disposed above an annular rib (53) protruding from the outer cap (30), thereby preventing the outer cap (30) from being removed from the inner shell (50). Blocking members (36) are not shown in FIG. 20.

Figure 25:
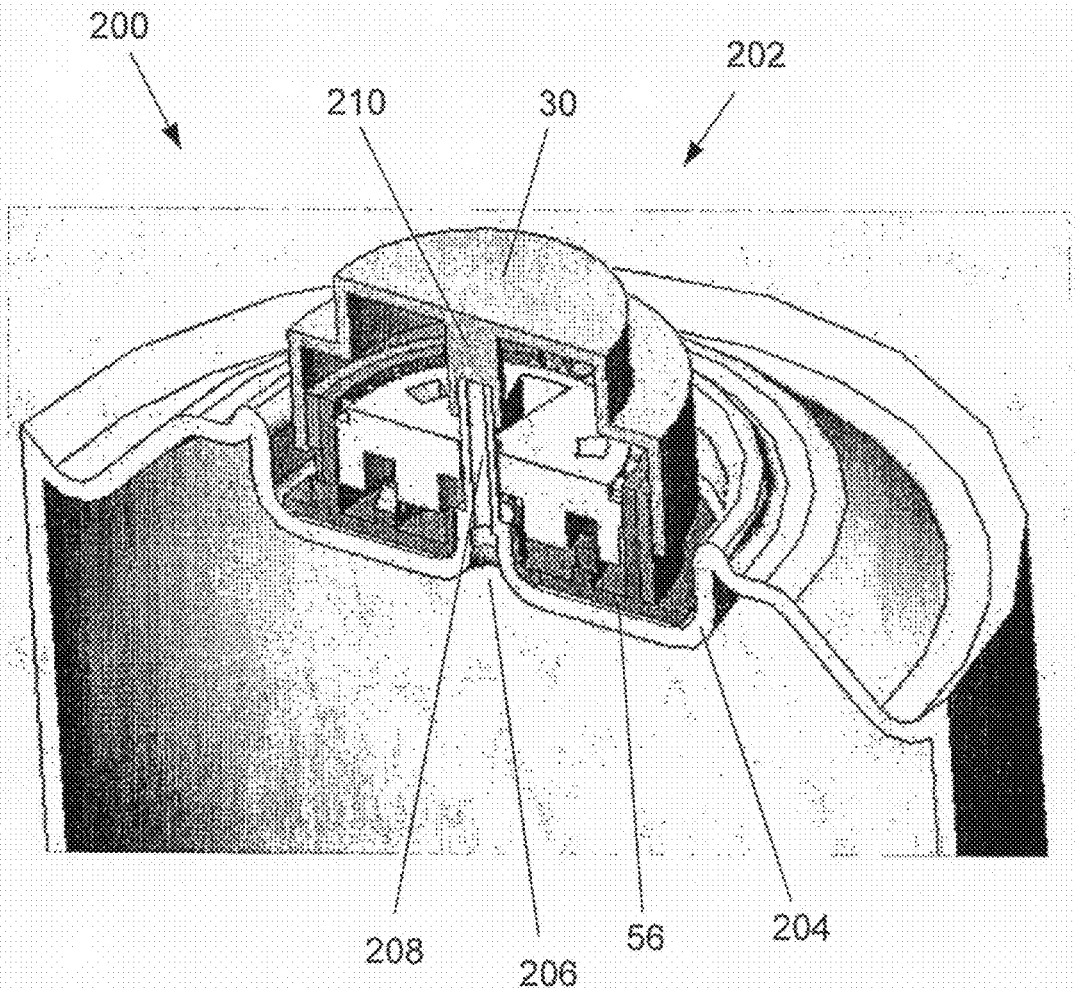
FIG. 25 illustrates a longitudinal cross-section of the upper portion of an aerosol can, wherein the third embodiment of the present invention is situated thereon, when the coupler is in the locked position.
Figure 26:
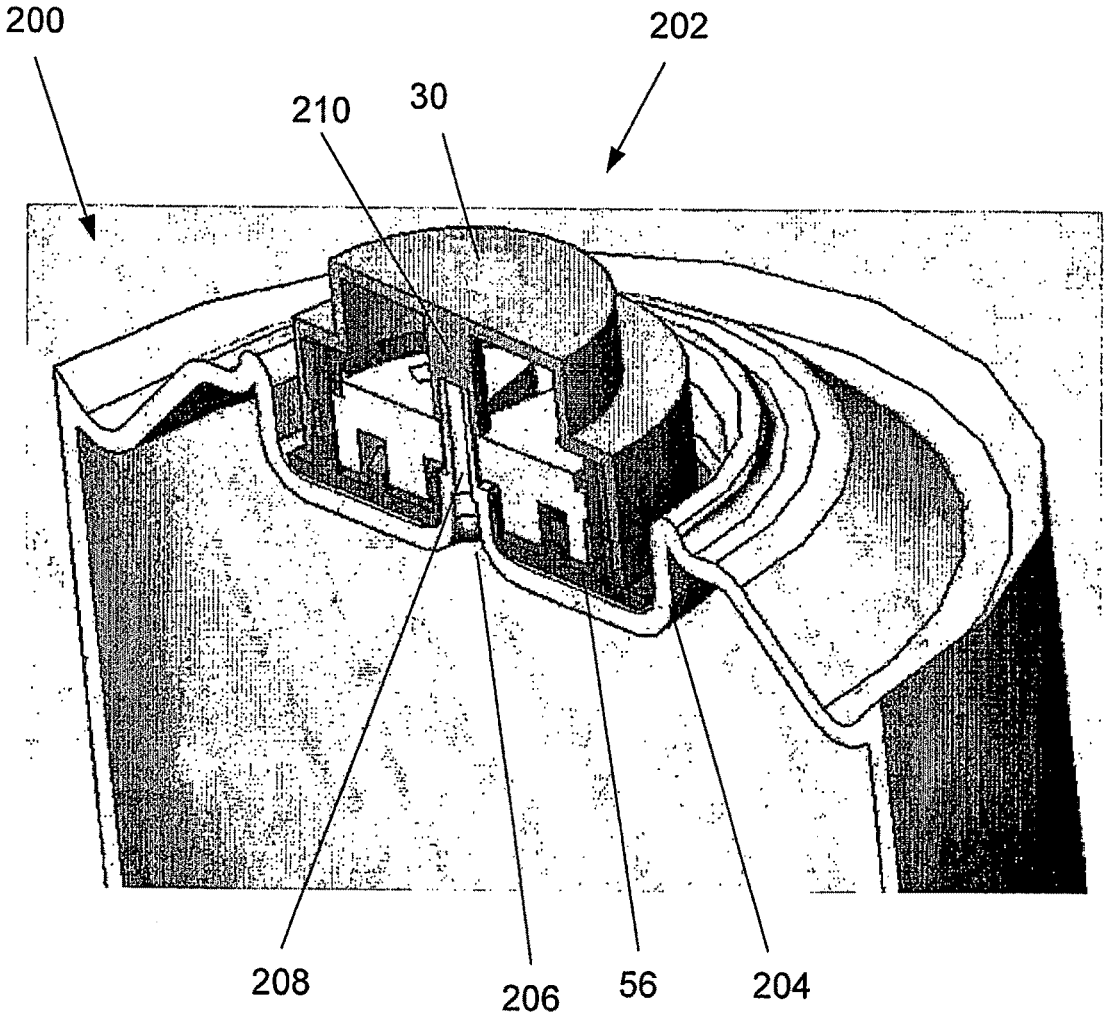
FIG. 26 illustrates the view shown in FIG. 25, wherein the coupler is in the unlocked position after the outer cap (the nozzle) has been pressed downward.
Figure 27:
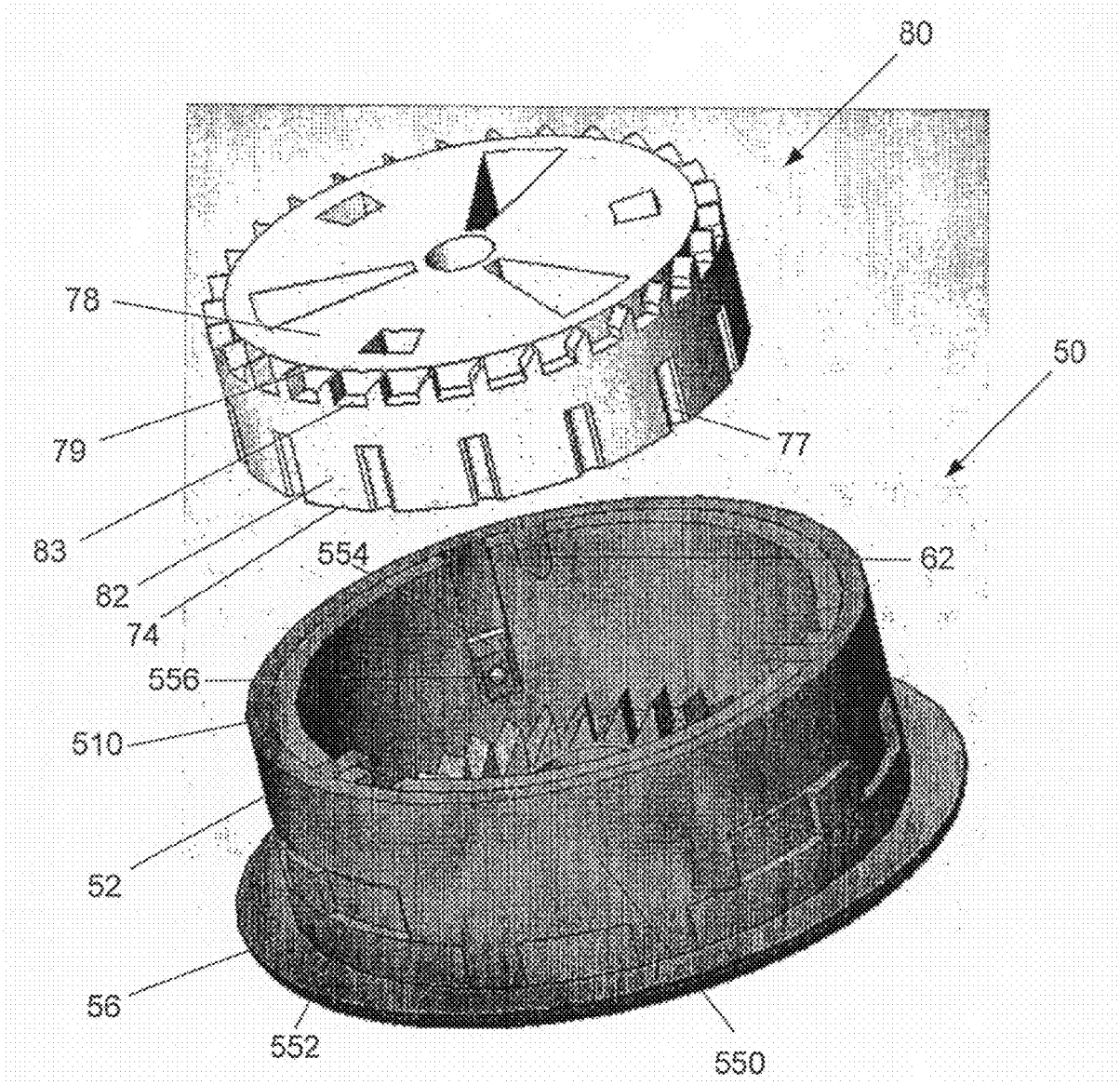
FIG. 27 illustrates the coupler and the inner shell of the third embodiment of the present invention, in an exploded view The present invention is defined by the claims, the contents of which are to be read as included within the disclosure of the specification, and will now be described by way of example with reference to the accompanying Figures.

A third embodiment of the present invention is shown in FIGS. 25-27, and comprises all of the elements of the second embodiment, as described herein above, *mutatis mutandis*, with the following differences. Referring to FIG. 25, a longitudinal cross-sectional view of the upper portion of a spray dispenser, such as an aerosol can (200), is shown. According to the third embodiment, the present invention takes the form of the head portion (202) of an aerosol can (200). The upper portion of the aerosol can (200) comprises a sunken neck portion (204) comprising a central opening (206) through which a hollow pin (208) protrudes upward. The nozzle member (210) is situated on the top of hollow pin (208), and is integrally joined with outer cap (30). Thus, the outer cap (30) and nozzle member (210) essentially replaces the nozzle member of a conventional aerosol can. When outer cap (30) is pressed downward, the contents of can (200) pass through hollow pin (208) and exit via the opening (not shown) in nozzle member (210).

Typically, the head portion (202) of an aerosol can (200) additionally comprises a removable cover (not shown) for protecting the outer cap (30) from being inadvertently pressed. According to the third embodiment of the present invention, in one state, the outer cap (30) is prevented from being inwardly pressed downward, thereby preventing the release of the contents of the can (200), without first shaking the cover assembly (10) at least once. Thus, rotation of the outer cap (30) and inner shell (50) is not part of the third embodiment of the present invention, as described herein below.

FIG. 27 shows the coupler (80) and the inner shell (50) according to the third embodiment of the present invention. The coupler (80) comprises a series of grooves (83) (thirty grooves (83) in the example shown in the figure), spaced along the outer surface (82) of the coupler (80) essentially radially equidistant from each other. Each groove (83) extends to essentially the same distance as each other from the edge (79) of the upper face (78) toward lower end (74) of the coupler (80). The coupler (80) further comprises a series of spring grooves (77) (fifteen spring grooves (77) in the example shown in the figure) spaced along the lower end (74) of the outer surface (82) of the coupler (80), essentially radially equidistant from each other.

The ring portion (550) of the inner shell (50), shown in FIG. 27 assembled around the shell portion (510), comprises three radially equidistant positioning elements (62) projecting radially inward therefrom for lodging within the grooves (83), as described herein below.

As seen in the figures, inner shell (50) is comprised of only the upper portion (52), wherein the partition (56) forms the base of the inner shell (50), for positioning in the sunken neck (204) of the aerosol can (200) (FIGS. 25 and 26).

Referring to FIGS. 25 and 26, the coupler (80) is situated within the inner shell (50), and the outer cap (30) is situated thereon. In FIG. 25, the coupler (80) is situated in the locked position, wherein the rounded protrusion (556) of the head portion (554) of the spring stoppers (552) (see FIG. 27) is in contact with the outer surface of the coupler (80) (as seen in, and corresponding to the portion of the coupler (80) shown in FIG. 23 regarding the second embodiment, *mutatis mutandis*), thereby preventing the outer cap (30) from being able to be pressed downward, as described herein above regarding the second embodiment, *mutatis mutandis*.

When the coupler (80) is in the locked position, upon applying a single shaking motion to the cover assembly and can (200), the coupler (80) rotates in a retrograde direction, such that each positioning element (62) becomes lodged in an adjacent groove (83) and each rounded protrusion (556) becomes lodged in respective spring grooves (77), thereby shifting the coupler (80) to the unlocked position, as described herein above regarding the second embodiment, *mutatis mutandis*. In the unlocked position, the outer cap (30) (and nozzle member (210)) may be pressed downward, thereby allowing the contents of the can (200) to be released. When pressing the outer cap (30) downward, the nozzle member (210) forces the coupler (80) downward such that the rounded protrusion (556) is freed from the groove stopper (77) (see FIG. 24, which corresponds to this position for the second embodiment). The coupler (80) rotates in a retrograde direction such that each positioning element (62) becomes lodged in an adjacent groove (83), thereby returning the coupler to the locked position.

When the coupler (80) is in the unlocked position, the force that would be provided if a further shaking motion were to be applied would typically not be large enough to free the spring stoppers (552) from the spring grooves (77). However, the force provided by the downward pressing motion will typically be much greater than that provided by the application of a shaking motion. Thus, only by pressing the outer cap (30) downward such that the nozzle member (210) forces the coupler (80) downward will the spring stoppers (552) be freed from the stopper grooves (77). According to the third embodiment, when the nozzle member (210) contacts the coupler (80), the outer cap (30) is defined as being engaged with the inner shell (50) via the coupler.

According to the third embodiment, as shown in FIGS. 25-27 and described herein, only one shaking motion is required in order to shift the coupler (80) from the locked position to the unlocked position. This is due to the 2:1 ratio between grooves (83) and spring grooves (77). However, it is understood that this is just an illustrative example, and any alternative ratio between the grooves (83), (77) is also within the scope of the third embodiment, such that the application of more than one shaking motion may be required in order to shift the coupler (80) from the locked position to the unlocked position.

While in the foregoing description describes in detail only a few specific embodiments of the invention, it will be understood by those skilled in the art that the invention is not limited thereto and that other variations in form and details may be possible without departing from the scope and spirit of the invention herein disclosed or exceeding the scope of the claims.

The invention claimed is:

1. A container cover assembly having at least two states, a first, closed state, in which the removal of the contents of the container through an opening of said container is prevented, and a second, open state, in which the removal of the contents of said container through said opening of said container is possible, wherein said cover assembly comprises a mechanism for preventing the transfer of said cover assembly from said first state to said second state, unless a predetermined number of more than one shaking motions is applied to said container and cover assembly.

2. The cover assembly according to claim 1, further comprising an inner shell for positioning around the opening of the container and an outer cap for covering said inner shell, and wherein the mechanism comprises a coupler situated within said inner shell for allowing said cap to engage with said inner shell.

3. The cover assembly according to claim 2, wherein in the second state, said cover assembly may be removed from the opening of the container.

4. The cover assembly according to claim 2, wherein the coupler comprises:

a. an upper face;

b. a lower face;

c. an inner surface; and, d. an outer surface having an upper end and a lower end, and comprising at least one series of grooves extending from said upper end toward said lower end, wherein each groove in said series has a first side wall, a second side wall and an upper edge, and said coupler further comprising at least one recessed segment having a first side wall and a second side wall.

5. The cover assembly according to claim 4, wherein each series of grooves comprises at least two grooves, thereby defining at least a first groove and a final groove, wherein said final groove extends longer than said first groove.

6. The cover assembly according to claim 4, wherein the upper end of the first side wall of each groove is chamfered.

7. The cover assembly according to claim 4, wherein the lower end of the outer surface of the coupler comprises an array of sawteeth.

8. The cover assembly according to claim 4, wherein the lower face of the coupler comprises at least one flexible stopper projecting downward therefrom, wherein each stopper comprises a fixed end that is affixed to said lower face, and a free end.

9. The cover assembly according to claim 8, wherein each stopper is inclined with respect to the lower face.

10. The cover assembly according to claim 4, wherein the lower face of the coupler comprises an array of spring members depending therefrom, wherein said spring members may be selected from a group consisting of:

a. compression springs;

b. torsion springs;

c. bending members.

11. The cover assembly according to claim 10, wherein the spring members provide support to the coupler such that upon compression, said coupler is lowered, and upon expansion, said coupler is raised.

12. The cover assembly according to claim 2, wherein the inner shell, having essentially cylindrical symmetry, comprises a longitudinal shell wall and a transversal partition, thereby defining a lower portion and an upper portion, wherein the inner surface of the shell wall of said lower portion is threaded to engage the opening of a container.

13. The cover assembly according to claim 12, wherein the inner surface of the shell wall of the upper portion comprises at least one positioning element projecting inward therefrom, dimensioned for lodging in a suitable groove, and at least one restricting element projecting inward therefrom, dimensioned for lodging in the recessed segment, wherein each of said positioning and restricting elements comprise a first side wall, a second side wall and a lower wall.

14. The cover assembly according to claim 13, wherein the coupler further comprises an array of spring grooves.

15. The cover assembly according to claim 14, wherein inner shell comprises a shell portion and a ring portion, wherein when assembled, said ring portion is situated around the upper portion of said shell portion, wherein, a. said ring portion comprises at least one positioning element projecting inward therefrom, dimensioned for lodging in a suitable groove, and at least one restricting element projecting inward therefrom, dimensioned for lodging in the recessed segment, wherein each of said positioning and restricting elements comprise a first side wall, a second side wall and a lower wall;

b. said upper portion comprises suitable openings for said positioning and restricting elements to be disposed therein; and, c. said upper portion further comprises a spring stopper comprising a head portion for selectively being lodged in and being dislodged from the spring groove.

16. The cover assembly according to claim 13, wherein the first side wall of the positioning element is chamfered at the lower end thereof.

17. The cover assembly according to claim 16, wherein when the positioning element is lodged in a first groove the coupler is defined as being in an initial, locked position, and when the positioning element is lodged in a final groove, the coupler is defined as being in a final, unlocked position.

18. The cover assembly according to claim 13, wherein the partition comprises an upper face having at least one flexible stopper projecting upward therefrom, wherein each stopper comprises a fixed end that is affixed to said upper face, and a free end having an upper tip.

19. The cover assembly according to claim 18, wherein each stopper is inclined with respect to the upper face of the partition.

20. The cover assembly according to claim 19, wherein the stopper is disposed below the sawteeth of the coupler such that the incline of the stopper is essentially parallel to that of the angled wall of each sawtooth.

21. The cover assembly according to claim 18, wherein each stopper is orthogonal to the upper face of the partition.

22. The cover assembly according to claim 13, wherein the partition comprises an upper face having an array of sawteeth extending therefrom.

23. The cover assembly according to claim 13, wherein the shell wall further comprises an outer surface having an annular rib extending around the periphery thereof.

24. The cover assembly according to claim 2, wherein the outer cap, having essentially cylindrical symmetry, comprises a longitudinal wall and an inwardly facing upper surface having a bolt member depending therefrom, wherein said bolt member is threaded to engage the inner surface of the coupler.

25. The cover assembly according to claim 24, wherein the longitudinal wall comprises a lower end having at least one blocking member protruding radially inward therefrom.

26. The cover assembly according to claim 2, wherein the coupler comprises a. an upper face;

b. a lower face;

c. an inner surface; and, d. an outer surface having an upper end and a lower end, and comprising a series of grooves situated along the circumference of said outer surface and extending from said upper end toward said lower end, wherein each groove has a first side wall, a second side wall and an upper edge, and wherein said coupler further comprises a series of spring grooves at said lower end.

27. The cover assembly according to claim 26, wherein the upper end of the first side wall of each groove is chamfered.

28. The cover assembly according to claim 26, wherein the lower face of the coupler comprises at least one flexible stopper projecting downward therefrom, wherein each stopper comprises a fixed end that is affixed to said lower face, and a free end.

29. The cover assembly according to claim 28, wherein each stopper is inclined with respect to the lower face.

30. The cover assembly according to claim 26, wherein the lower face of the coupler comprises an array of spring members depending therefrom, wherein said spring members may be selected from a group consisting of:

a. compression springs;

b. torsion springs;

c. bending members.

31. The cover assembly according to claim 30, wherein the spring members provide support to the coupler such that upon compression, said coupler is lowered, and upon expansion, said coupler is raised.

32. The cover assembly according to claim 26 wherein the inner shell comprises a longitudinal shell wall and a transverse partition, and further comprises a shell portion and a ring portion, wherein when assembled, said ring portion is situated around said shell portion, wherein, a. said ring portion comprises at least one positioning element projecting inward therefrom, dimensioned for lodging in a suitable groove, wherein each of said positioning elements comprises a first side wall, a second side wall and a lower wall;

b. said shell portion comprises suitable openings for said positioning elements to be disposed therein; and, c. said shell portion further comprises a spring stopper comprising a head portion for selectively being lodged in and being dislodged from the spring groove.

33. The cover assembly according to claim 32, wherein the first side wall of the positioning element is chamfered at the lower end thereof.

34. The cover assembly according to claim 32, wherein when the positioning element is lodged in a first groove the coupler is defined as being in an initial, locked position, and when the positioning element is lodged in a final groove, the coupler is defined as being in a final, unlocked position.

35. The cover assembly according to claim 32, wherein the partition comprises an upper face having an array of sawteeth extending therefrom.

36. The cover assembly according to claim 32, wherein the shell wall further comprises an outer surface having an annular rib extending around the periphery thereof.

37. The cover assembly according to claim 32, wherein the inner shell is situated at a neck portion of an aerosol can.

38. The cover assembly according to claim 37, wherein the outer cap, having essentially cylindrical symmetry, comprises a longitudinal wall and an inwardly facing upper surface integrally joined with a nozzle member of the aerosol can, depending therefrom.

39. The cover assembly according to claim 1, wherein each of the more than one shaking motion is applied in an axial direction.

40. A method for enabling the removal of the contents of a container only after applying at least a predetermined number of shaking motions to the container and cover assembly, said method comprising:

a. providing a cover assembly for said container, said cover assembly having at least a closed state and an open state; wherein said cover assembly comprises a mechanism for preventing the transfer of said cover from said closed state to said open state, unless a predetermined number of more than one shaking motions is applied to said container and cover assembly;

b. when removal of the container contents is desired, applying said predetermined number of shaking motions to said container and cover assembly; thereby transferring said cover from said closed state to said open state.

41. The method according to claim 40, further comprising providing a downward force to said cover assembly.

42. The method according to claim 40, further comprising rotating said cover assembly in a predetermined direction.

* * * * *